US008109229B2

(12) United States Patent
Arnaboldi

(10) Patent No.: US 8,109,229 B2
(45) Date of Patent: Feb. 7, 2012

(54) SPREADING HEAD PARTICULARLY FOR SPREADING ONE OR MORE ADHESIVES OR MIXTURES OF ADHESIVES

(75) Inventor: Riccardo Arnaboldi, Spresiano (IT)

(73) Assignee: HIP-MITSU S.R.L., Spresiano (IT)

( * ) Notice: Subject to any disclaimer, the term of this patent is extended or adjusted under 35 U.S.C. 154(b) by 629 days.

(21) Appl. No.: 11/808,276

(22) Filed: Jun. 8, 2007

(65) Prior Publication Data

US 2008/0011227 A1 Jan. 17, 2008

(30) Foreign Application Priority Data

Jul. 17, 2006 (IT) ..... TV2006A0124

(51) Int. Cl.
*B05C 5/02* (2006.01)

(52) U.S. Cl. ..... 118/411; 118/412; 118/429; 425/131.1; 425/133.5; 425/382 R; 425/462; 425/465; 156/500; 156/578

(58) Field of Classification Search ..... 347/98, 347/73; 118/313, 411, 412, 429; 425/133.5, 425/382 R, 462, 465, 131.1; 156/244.11, 156/500, 578; 427/286, 356
See application file for complete search history.

(56) References Cited

U.S. PATENT DOCUMENTS

| | | | | |
|---|---|---|---|---|
| 2,374,069 | A * | 4/1945 | Balthis | 264/211 |
| 3,508,947 | A * | 4/1970 | Hughes | 430/538 |
| 3,887,322 | A * | 6/1975 | Johnson et al. | 425/466 |
| 5,075,139 | A | 12/1991 | Crumbach et al. | |
| 5,120,484 | A | 6/1992 | Cloeren | |
| 5,769,947 | A * | 6/1998 | Krappweis | 118/411 |
| 6,467,893 | B1 * | 10/2002 | Matsumoto et al. | 347/98 |
| 6,837,698 | B2 * | 1/2005 | Floyd et al. | 425/131.1 |

FOREIGN PATENT DOCUMENTS

| | | |
|---|---|---|
| EP | 1 101 537 A1 | 5/2001 |
| EP | 1 316 368 A1 | 6/2003 |

* cited by examiner

*Primary Examiner* — Laura Edwards
(74) *Attorney, Agent, or Firm* — Modiano & Associati; Albert Josif; Daniel J. O'Byrne

(57) ABSTRACT

A spreading head particularly for spreading one or more adhesives or mixtures of adhesives, of the hot-melt or cold type, comprising a body for conveying the one or more adhesives to an extrusion tool; the body has two or more ducts, which are all separate or of which two or more converge, and the tool has one or more first extrusion channels and/or one or more mixing chambers which are connected to one or more second extrusion channels, the first and/or second extrusion channels being optionally mutually superimposed and/or laterally adjacent.

55 Claims, 18 Drawing Sheets

SPREADING HEAD PARTICULARLY FOR SPREADING ONE OR MORE ADHESIVES OR MIXTURES OF ADHESIVES

The present invention relates to a spreading head particularly for spreading one or more adhesives or mixtures of adhesives, both of the hot-melt type and of the cold type.

BACKGROUND OF THE INVENTION

Currently it is known to use, for the application of adhesives to substrates made of various materials such as for example fabrics or ribbons made of plastic material, spreading devices which comprise one or more spreading heads provided with a duct for feeding the adhesive, the delivery end of which faces, during use, a substrate which is made to advance in close contact therewith in the form of a ribbon.

The adhesive is introduced in the duct in the liquid state, typically by means of appropriately provided gear pumps, and can be applied either continuously or intermittently, by throttling the flow thereof by means of appropriately provided valves of a known type which are arranged in the spreading head.

Such valves further allow to vary the width of the region of application of the adhesive and to perform throttlings of said adhesive, with a preset pitch, transversely to the ribbon of substrate.

As an alternative to the valves, the variation of the width of the region of application of the adhesive can also be achieved by means of one or more inserts of a known type, which can be arranged automatically or manually within the duct so as to partially obstruct its cross-section, so as to adapt its width to the width of the tape.

It is also known to insert, transversely to the duct, appropriately provided contoured laminas, which are suitable to obstruct said duct partially so as to be able to obtain a chosen distribution of the adhesive transversely to the substrate; it is thus possible to achieve, for example, a distribution of the adhesive which affects uniformly the entire substrate or also a distribution of the so-called "multiline" type, which is constituted by a plurality of longitudinal layers of adhesive which are mutually parallel and spaced.

These known types of spreading head, however, have drawbacks: first of all, they do not allow to obtain layers of different adhesives arranged side-by-side or laterally adjacent layers of a same adhesive with different grammages.

Moreover, the use of these known types of head entails a waste of adhesive if an adhesive of higher value and/or grammage (therefore also having a structural function) is required only in some regions of the substrate while in other regions an adhesive of lower value and/or grammage is sufficient, since it forces to use the higher-value and/or higher-grammage adhesive for all the regions of the substrate.

Moreover, said known types of head allow to obtain only a uniform film of adhesive in contact with both surfaces of the materials to be coupled; this entails the need to use a high-value adhesive even if its use is required only by one of the two surfaces to be coupled, with an additional waste of material.

Further, if the substrate is porous, the use of known types of head entails an additional waste of high-value adhesive, since said adhesive also acts as a filler for the pores of the substrate.

There are also applications in which said known types of head are used to provide membranes which in some regions must have breathability characteristics, and therefore require low grammages of applied adhesive, and in other regions must instead provide a vapor barrier effect and therefore require high adhesive grammages; to obtain this embodiment, known types of head require a double passage over the substrate, which is performed either with different heads or with a same head which is modified at a later time, and this increases the production times, and therefore the production costs, of producing said membranes.

Moreover, in the case of adhesives that have to be mixed with catalysts before they are spread, mixing must be performed before injection into the head, and this causes severe problems if it is necessary to stop the machine, since the adhesive, after being mixed with the catalyst, must be spread onto the substrate in a short time.

Further, if subsequent productions require the use of adhesives with different chemical properties and/or colorings, and said properties and/or colorings are mutually incompatible, it is necessary to clean the heads before applying the new adhesive, and this requires complete disassembly of the heads and the full cleaning of all the ducts, with consequent long times and high costs for execution.

Moreover, since many thermoplastic adhesives have a residual stickiness after their spreading, it is not possible to apply them with a double pass.

In the case of cold adhesives, spreading heads are known which allow to apply a plurality of superimposed layers; however, said heads do not allow to perform combined applications, i.e., multilayer products in certain regions and single-layer products in other regions, and also do not allow intermittent and/or combined applications of the so-called "multiline" type.

SUMMARY OF THE INVENTION

The aim of the present invention is to solve the above mentioned problems, eliminating the drawbacks of the cited background art, by providing a spreading head which allows to spread one or more adhesives onto a substrate, so as to obtain, in chosen regions thereof, layers of the chosen type of chosen adhesive and/or of the chosen grammage.

Within this aim, an object of the invention is to provide a spreading head which allows to obtain, even in a single pass, the spreading onto a substrate of two or more superimposed layers of one or more adhesives.

Another object of the invention is to allow the mixing of a plurality of adhesives or of an adhesive and a catalyst, limiting the head cleaning time and further reducing the waste of adhesive that has already been mixed with a catalyst if the spreading process is interrupted.

Another object is to provide a spreading head which allows to achieve the spreading of one or more adhesives in a plurality of layers which are arranged side-by-side and optionally mutually spaced, in which each layer has the chosen characteristics of width and/or composition and/or grammage and/or number of superimposed layers that compose it.

Another object of the invention is to facilitate the operations for cleaning the spreading head.

Another object is to provide a spreading head which allows the spreading in rapid succession of adhesives having different chemical properties and/or colorings, which may even be mutually incompatible.

Another object of the invention is to reduce the time and cost for producing membranes which have breathable regions and vapor-permeable regions.

Another object of the invention is to reduce the waste of high-value adhesive in the process for spreading it onto a substrate, even a porous one.

Another object of the invention is to achieve a reduction in the costs for spreading one or more adhesives onto a substrate.

Another object is to provide a spreading head which is structurally simple and has low manufacturing costs.

This aim and these and other objects, which will become better apparent hereinafter, are achieved by a spreading head particularly for spreading one or more adhesives or mixtures of adhesives, of the hot-melt or cold type, comprising a body for conveying said one or more adhesives to an extrusion tool, characterized in that said body has two or more ducts, which are all separate or of which two or more converge, and in that said tool has one or more first extrusion channels and/or one or more mixing chambers which are connected to one or more second extrusion channels, said first and/or second extrusion channels being optionally mutually superimposed and/or laterally adjacent.

BRIEF DESCRIPTION OF THE DRAWINGS

Further characteristics and advantages of the invention will become better apparent from the following detailed description of a particular but not exclusive embodiment thereof, illustrated by way of non-limiting example in the accompanying drawings, wherein.

DESCRIPTION OF THE PREFERRED EMBODIMENTS

Figure 1:
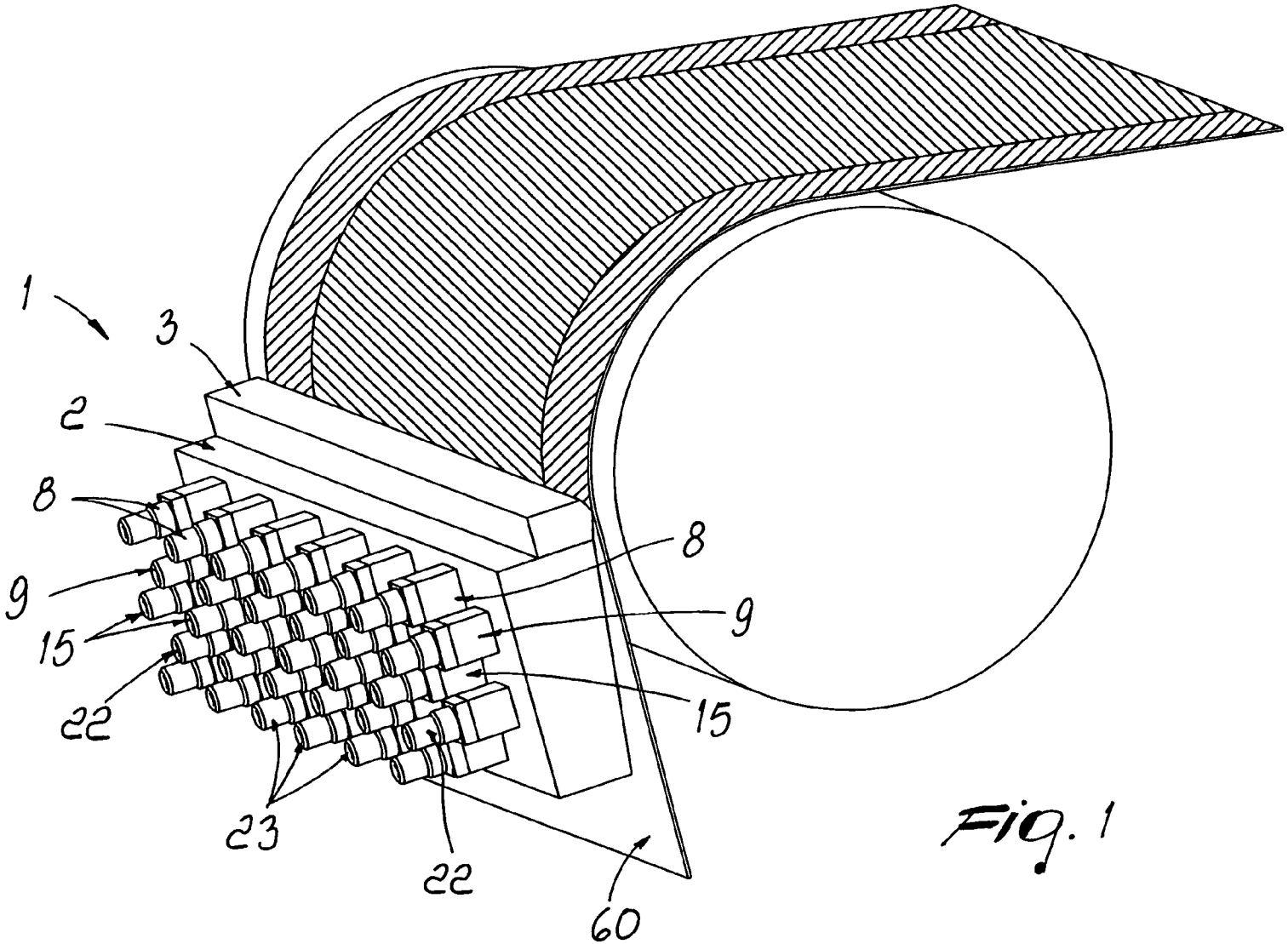
FIG. 1 is a perspective view of a spreading head according to the invention during its use.

In the exemplary embodiments that follow, individual characteristics, given in relation to specific examples, may actually be interchanged with other different characteristics that exist in other exemplary embodiments.

Moreover, it is noted that anything found to be already known during the patenting process is understood not to be claimed and to be the subject of a disclaimer.

With reference to the accompanying figures, the reference numeral 1 generally designates a spreading head, particularly for one or more adhesives or mixtures of adhesives, of the hot-melt or cold type, on an appropriately provided substrate 60 constituted for example by a tape made of fabric or plastic material.

The spreading head 1 is constituted by a body 2 for conveying such one or more adhesives to an extrusion tool, designated by the reference numeral 3.

Advantageously but not necessarily, the body 2 is approximately shaped like a parallelepiped with a transverse cross-section which is approximately shaped like a right-angled trapezoid.

Two or more ducts are formed within the body 2; all of said ducts are separate or two or more of them converge.

Figure 2:
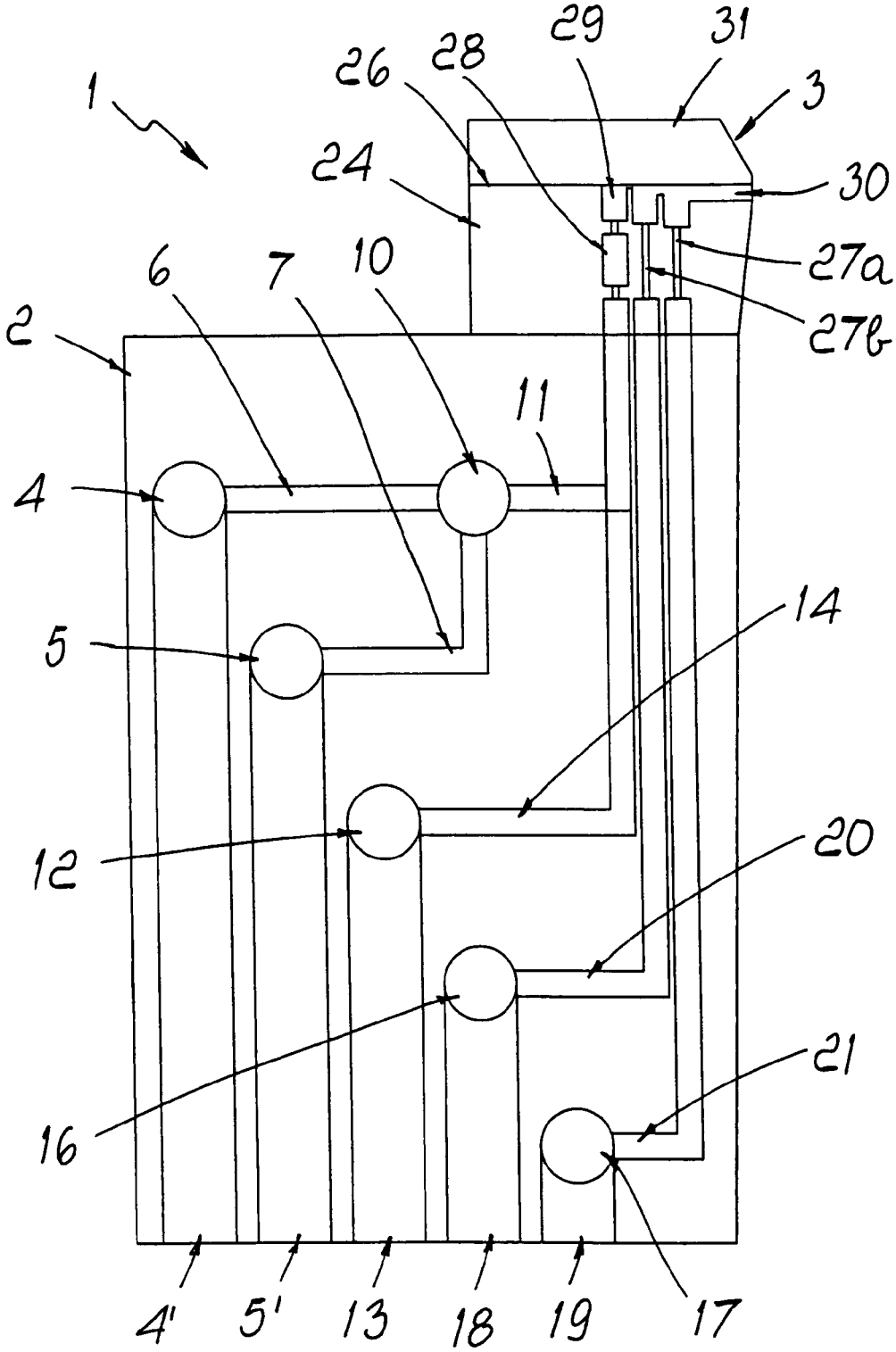
FIG. 2 is a schematic transverse sectional view of the spreading head of FIG. 1, in which the valves have not been shown and the second feed channels have been highlighted, said channels actually being not visible because they are arranged on different planes.

With reference to FIGS. 1 and 2, the body 2 has a first duct and a second duct, designated respectively by the reference numerals 4 and 5, which are approximately mutually parallel and affect longitudinally the body 2, preferably along most of its width; advantageously, the first and second ducts 4 and 5 respectively have one or more first and second accesses, designated respectively by the reference numerals 4' and 5', from which it is possible to introduce, for example by means of appropriately provided rotary pumps, not shown in the accompanying figures, one or more adhesives or mixtures of adhesives or catalysts for adhesives.

Advantageously, the first and second ducts 4 and 5 mutually converge inside the body 2; the first and second ducts 4 and 5 are connected respectively to first and second output ducts, designated respectively by the reference numerals 6, and 7, which converge in pairs, with the interposition of appropriately provided first and second valves of a known type, designated respectively by the reference numerals 8 and 9, within appropriately provided mixing channels 10, from each of which a first feed channel 11 protrudes which is connected in output to the extrusion tool 3.

Advantageously, the first and second output ducts 6 and 7 are formed along axes which are substantially perpendicular to the first and second ducts 4 and 5; the first and second output ducts 6 and 7 are present in a chosen number and are distributed, in a preferably equidistant arrangement, respectively along the first and second ducts 4 and 5.

With reference to FIGS. 1 and 2, the body 2 has a third duct 12, which is approximately parallel to the first and second ducts and again affects longitudinally the body 2 preferably along most of its width.

The third duct 12 has one or more third accesses 13 for an adhesive or a mixture of adhesives or catalyst for adhesives.

One or more second feed channels 14 exit from the third duct 12, are connected in output to the extrusion tool 3, and are connected to the third duct 12 by means of appropriately provided third valves 15 of a known type; advantageously, the outputs of the second feed channels 14 and of the first feed channels 11 are aligned along a same longitudinal axis with respect to the body 2.

Advantageously, the second feed channels 14 are formed along axes which are substantially perpendicular to the longitudinal axis of the third duct 12; the second feed channels 14 are provided in a chosen number and are distributed, preferably in an equidistant configuration, along the third duct 12.

The body 2 further has a fourth duct and a fifth duct, designated respectively by the reference numerals 16 and 17, which are approximately parallel to the first, second and third ducts and affect longitudinally the body 2 preferably along most of its width; the fourth and fifth duct 16 and 17 respectively have fourth and fifth accesses, designated respectively by the reference numerals 18 and 19, for an adhesive or a mixture of adhesives or catalysts for adhesives.

Respectively one or more third feed channels 20 and one or more fourth feed channels 21 exit from the fourth and fifth ducts 16 and 17, are connected in output to the extrusion tool 3 and are connected to the respective fourth and fifth ducts respectively by means of appropriately provided fourth and fifth valves of a known type, designated respectively by the reference numerals 22 and 23.

Advantageously, the outputs of the third and fourth feed channels 20 and 21 are aligned respectively along two axes which are arranged longitudinally with respect to the body 2 and are substantially parallel and spaced with respect to each other and with respect to the axis along which the outputs of the first and second feed channels 11 and 14 are aligned.

Advantageously, the third and fourth feed channels 20 and 21 are formed along axes which are substantially perpendicular respectively to the longitudinal axes of the fourth and fifth ducts 16 and 17; the third and fourth feed channels 20 and 21 are provided in a chosen number and are distributed, preferably equidistantly, respectively along the fourth and fifth ducts 16 and 17.

Advantageously, the extrusion tool 3 is constituted by a lower element 24, which can be fixed to the contiguous body 2 and is preferably shaped approximately like a parallelepiped, with a transverse cross-section shaped like a right-angled trapezoid arranged so that its shorter parallel side 25 engages the body 2 and its longer parallel side 26 is directed away from it.

One or more first extrusion channels, designated by the reference numerals 27*a* and 27*b*, are formed in the lower element 24 of the extrusion tool 3, and are optionally mutually superimposed and/or laterally adjacent; each channel is connected in input to one of the first and/or second and/or third and/or fourth feed channels which exit from the body 3.

In the example shown in the accompanying figures, the first extrusion channels 27*a* and 27*b* are connected respectively to the third feed channels 20 and to the fourth feed channels 21 formed within the body 2.

Figure 3:
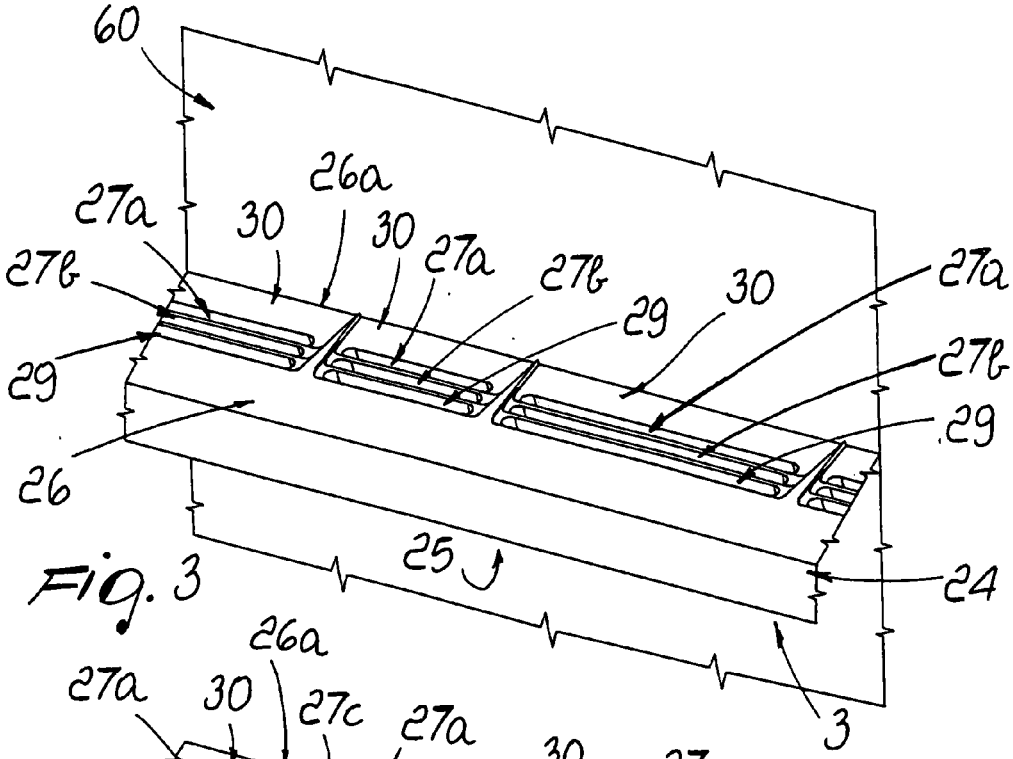
FIG. 3 is a perspective view of a detail of the extrusion tool of a spreading head according to the invention.

The embodiment shown in FIG. 3 shows multiple pairs of first extrusion channels 27*a* and 27*b*, which are mutually superimposed in pairs (i.e., are arranged parallel to each other and to the longitudinal axis of the lower element 24) and are also mutually laterally adjacent in pairs; hereinafter, the first extrusion channel 27*a*, which lies closest to the perimetric edge 26*a* of the longer parallel side 26 which during use is directed toward the substrate 60 will be also referenced as front channel, and the adjacent first extrusion channel 27*b* will be also referenced as rear channel.

The longitudinal extension of the first extrusion channels 27*a* and 27*b* of each pair is identical, while the longitudinal extension of two laterally adjacent pairs of said first extrusion channels 27*a* and 27*b* may be different.

Advantageously, in each pair of first mutually superimposed extrusion channels 27*a* and 27*b* the outlet of the first extrusion channel arranged in a rearward position (the channel 27*b* with reference to FIG. 3) is, with respect to the throttling plane, at a greater elevation than the adjacent first channel arranged in a forward position (the one designated in FIG. 3 by the reference numeral 27*a*).

As described hereinafter, the plane of arrangement of the first (front) extrusion channel 27*a* which is adjacent to the first (rear) extrusion channel 27*b* lies at a lower level than the first (rear) extrusion channel 27*b*, in order to allow to extrude two superimposed layers of adhesive which, after flowing out of the respective first channel 27*a* or 27*b*, remain one on top of the other due to their different relative densities.

Figure 4:
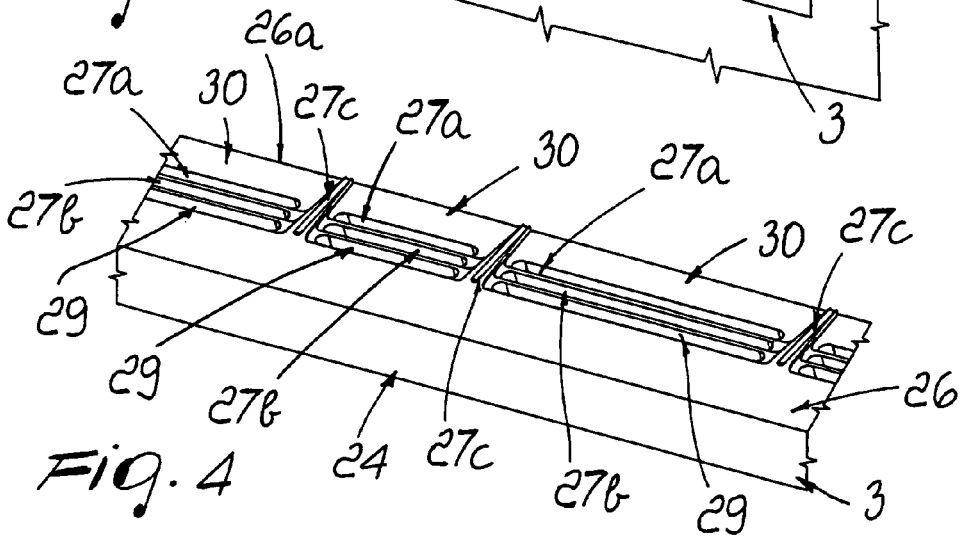
FIG. 4 is a perspective view of a detail of a second embodiment of the extrusion tool of a spreading head according to the invention.

As an alternative, as shown in FIG. 4, there can be one or more additional first extrusion channels, designated by the reference numeral 27*c*, which have different configurations and arrangements with respect to the first extrusion channels

27*a* and 27*b*; the additional first extrusion channels 27*c* are arranged along an axis which is perpendicular to the axis of the first extrusion channels 27*a* and 27*b* and is interposed between each of the pairs of the first extrusion channels 27*a* and 27*b*.

The additional first extrusion channels 27c extend from the perimetric edge 26*a* of the longer parallel side 26 of the lower element 24 which during use is directed toward the substrate 60; as described in greater detail hereinafter, this configuration of the first extrusion channels allows to obtain in output laterally adjacent layers of adhesive spaced by microlayers of reduced width.

Advantageously, one or more mixing chambers 28 can further be provided in the lower element 24 of the extrusion tool 3, each chamber being connected to one or more second extrusion channels 29, which like the first extrusion channels 27*a* and 27*b* are optionally superimposed and/or laterally adjacent with respect to each other and/or with respect to the first extrusion channels 27*a*, 27*b*; in the example shown in the accompanying figures, the second extrusion channels 29 are mutually laterally adjacent, and each channel is superimposed on a pair of first extrusion channels 27*a* and 27*b*.

The configuration and therefore the size of the second extrusion channels 29 follow those of the first extrusion channels 27*a* and 27*b* at each of the pairs of the channels on which they are superimposed.

As described hereinafter, the plane of arrangement of each second extrusion channel 29 is at a higher level than the adjacent first (rear) extrusion channel 27*b*, in order to allow the extrusion of three superimposed layers of adhesive which, after flowing out respectively from the second extrusion channel 29 and from the adjacent first extrusion channels 27*a* and 27*b*, remain one on top of the other due to their different relative densities.

Figure 6:
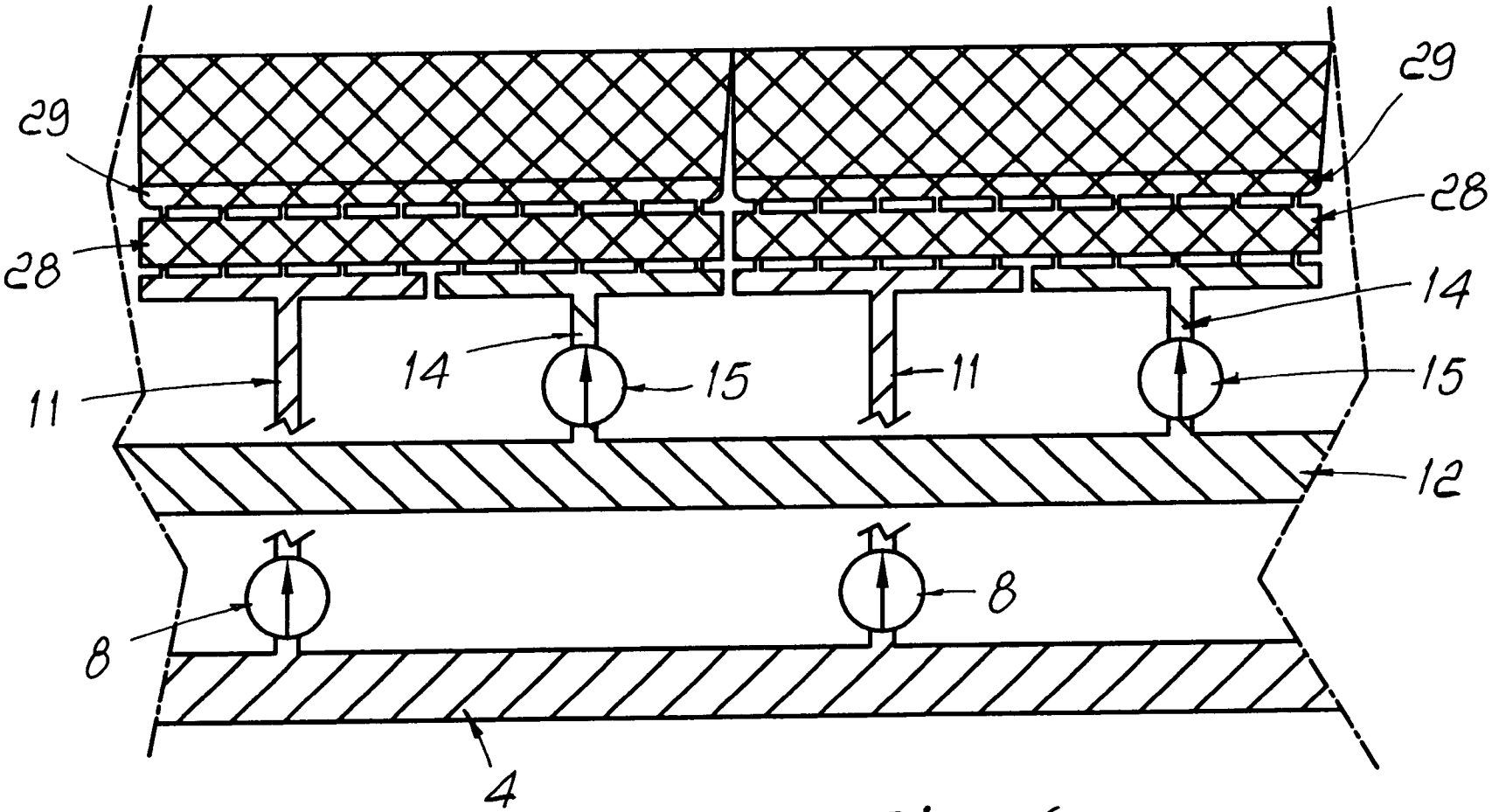
FIG. 6 is a schematic view of the flows of adhesives in a spreading head according to the invention.
Figure 7:
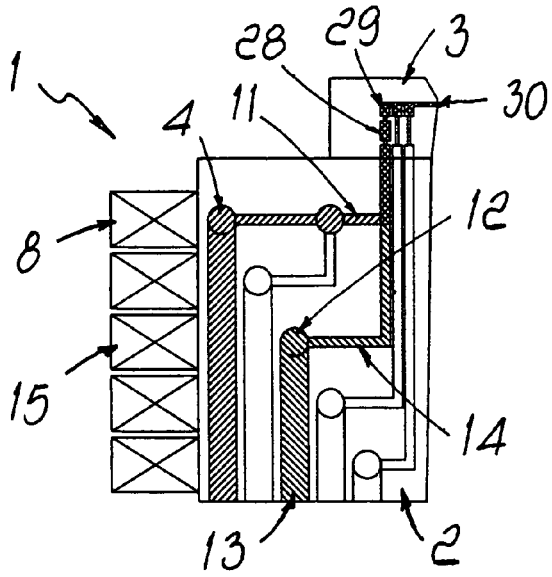
FIG. 7 is a transverse sectional view of a particular operating condition of a head according to the invention, in which the second feed channels have been highlighted, said channels actually being not visible because they are arranged on different planes.
Figure 8:
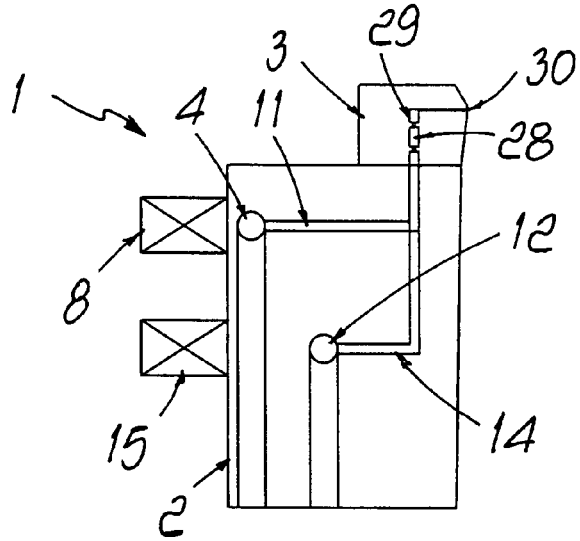
FIG. 8 is a transverse sectional view, which highlights the second feed channels, which are actually not visible because they are arranged on different planes, of a simplified configuration of a head according to the invention, which corresponds to the particular operating condition given in the description with reference to FIG. 7.

As illustrated schematically in FIG. 6 (in which, for the sake of clarity, the mixing channel 10 has not been shown), each mixing chamber 28 is connected to at least one of the first and at least one of the second feed channels 11 and 14 formed within the body 2; in this manner, it is possible to make two or more different adhesives (shown in FIG. 6 by means of two shadings with opposite inclinations), or a chosen adhesive and the respective catalyst, converge in the mixing chambers 28 in order to achieve mixing directly within the extrusion tool 3.

Figure 5:
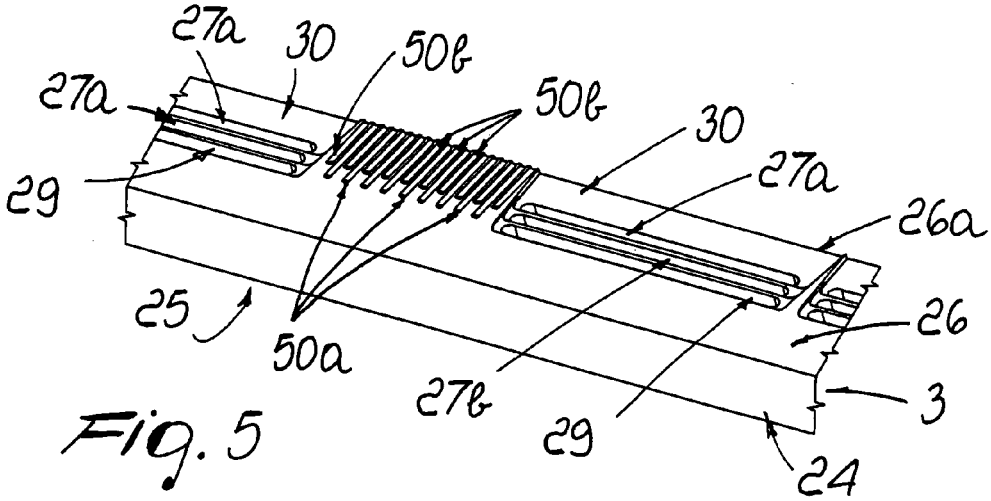
FIG. 5 is a perspective view of a detail of a third embodiment of the extrusion tool of a spreading head according to the invention.

As described, the various pairs of first extrusion channels 27*a*, 27*b* which are mutually superimposed and the adjacent second extrusion channels 29 may have mutually different extensions; thus, for example, as shown in FIGS. 3, 4 and 5, some pairs of first extrusion channels 27*a* and 27*b* which are mutually superimposed and the adjacent second extrusion channels 29 may have a shorter extension than the pairs of first extrusion channels 27*a* and 27*b* which are mutually superimposed and than the adjacent second extrusion channels 29, allowing to obtain in output layers of adhesive which are laterally adjacent and have different widths.

Advantageously, on the longer parallel side 26 of the lower element 24 of the extrusion tool 3 there is a slit 30, provided preferably by removing material and so as to affect the outlet of at least the first (front) extrusion channels 27*a*: said slit arranges on a lower plane the outlet of the first (front) extrusion channel 27*a* with respect to the plane of arrangement of the first (rear) extrusion channel 27*b* and of the second extrusion channel 29.

The slit 30 guides the outflow of the layer or layers of adhesive from the extrusion tool 3 onto the substrate 60.

In another embodiment, shown in FIG. 5, one or more of the first extrusion channels 27*a*, 27*b* and/or of the additional first extrusion channels 27*c* and/or of the second extrusion channels 29 may have, along an axis which lies longitudinally with respect to the lower element 24, reduced lengths so as to constitute microchannels which are designated by the reference numerals 50*a* and 50*b*.

In the embodiment shown in FIG. 5, the microchannels 50*a* and 50*b* are arranged at right angles to the first and second extrusion channels, are mutually parallel and are interposed between two pairs of the first and second extrusion channels 27*a*, 27*b* and 29.

The configuration of the microchannels 50*a* and 50*b* with respect to the longer parallel side 26 of the lower element 24 of the extrusion tool 3 is preferably comb-like, with teeth which advantageously have two different lengths and are arranged preferably alternately.

Advantageously, the extrusion tool 3 further comprises an upper element 31, which can be fixed to the longer parallel side 26 of the lower element 24 and is preferably approximately shaped like a parallelepiped, with a transverse cross-section shaped like a right-angled trapezoid.

The upper element 31 therefore acts as an abutment for the adhesive or adhesives that exit from the first and second channels formed in the lower element 24, thus guiding the adhesive or adhesives to exit from the slits 30.

Operation is therefore as follows: with reference to the accompanying figures, it is possible to introduce, for example by means of appropriately provided rotary pumps, not shown in the accompanying figures, one or more adhesives or mixtures of adhesives in the liquid state, or optionally one or more appropriately provided catalysts, in one or more among the first duct 4, the second duct 5, the third duct 12, the fourth duct 16 and the fifth duct 17.

By adjusting appropriately the open or closed state of the first, second, third, fourth and fifth valves, it is possible to feed into the extrusion tool 3 the chosen adhesive or mixture of adhesives so as to obtain, in output from the extrusion tool 3, a chosen configuration of the spread layer or layers of adhesive.

For example, with reference to FIGS. 7 to 11, it is possible to feed just the first duct 4 and the third duct 12 with two separate adhesives or alternately with the same adhesive having a different grammage, or also with an adhesive and an appropriately provided catalyst.

Figure 10:
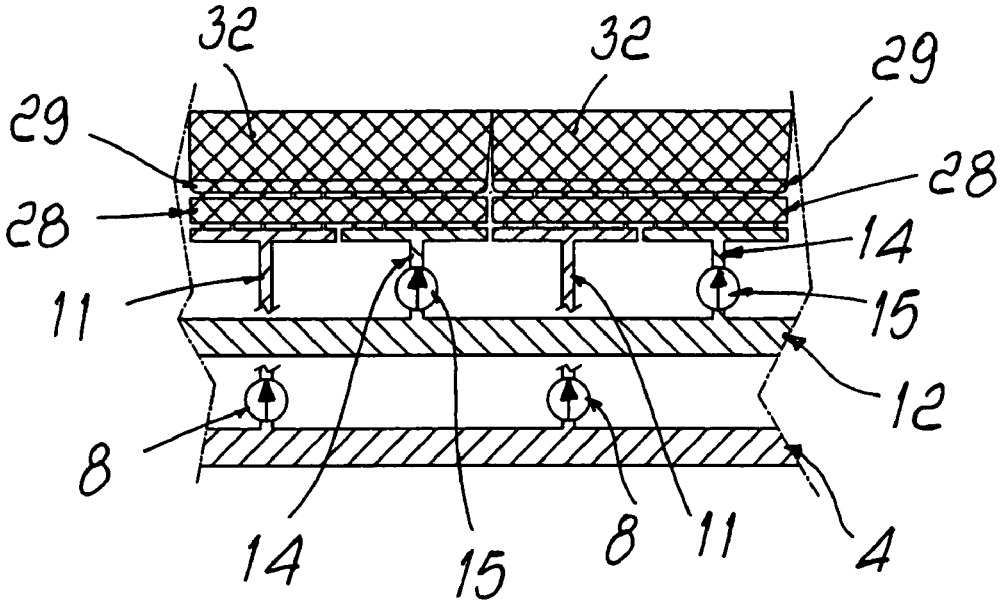
FIG. 10 is a schematic view of the path of the flows of the adhesives in the operating condition described for FIG. 7.

As shown in FIG. 10, by opening one or both of the first and third valves which are interposed respectively between the first duct 4, the third duct 12 and a same mixing chamber 28, it is possible to allow the access to the mixing chamber 28 of just one or both of the adhesives or mixture of adhesives or adhesive and catalyst that are present respectively in the first duct 4 and in the third duct 12.

If, as shown in FIG. 10, both the first valve 8 and the third valve 15 are open, in the mixing chamber 28 mixing occurs between the two adhesives or between the adhesive and the catalyst, contained respectively in the first and third ducts; from the mixing chamber 28, through the second extrusion channel 29, the mixture of adhesives or the adhesive mixed with the catalyst is then extruded by the extrusion tool 3 through the slit 30.

As an alternative, if only one of the first and third valves respectively of the first feed channel 11 and of the second feed channel 14 that lead into a same mixing chamber 28 is open, only one of the two adhesives flows into said chamber and therefore exits directly from the extrusions tool 3.

Figure 9:
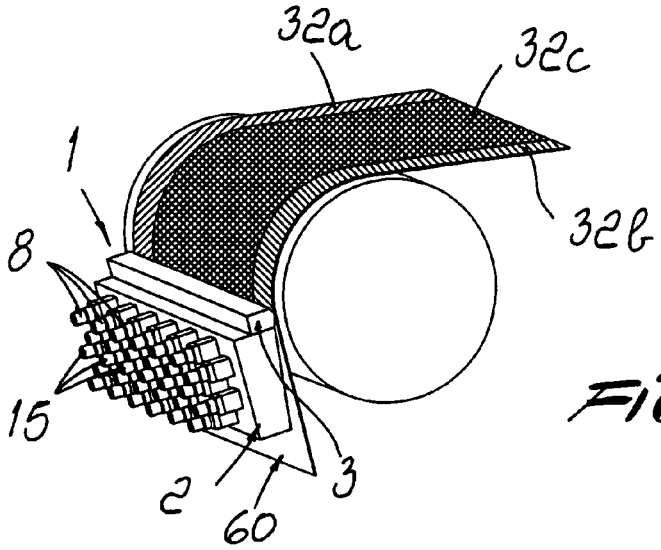
FIG. 9 is a perspective view of the head of FIG. 7.

In this manner it is therefore possible to obtain a plurality of layers of adhesive 32 which are laterally mutually adjacent and have the chosen composition; the embodiment shown in FIG. 9, for example, obtains a first layer 32*a* of a first adhesive, a second layer 32*b* of a second adhesive and a third layer 32*c*, which is interposed laterally between the preceding ones and is constituted by a mixture thereof.

This distribution of the layers of adhesive in output can also be achieved with a simplified configuration of the spreading head 1 in which the body 2 has only the first duct 4 and the third duct 12, from which a corresponding number of first and second feed channels 11 and 14 exit respectively through one or more first valves 8 and third valves 15.

Figure 11:
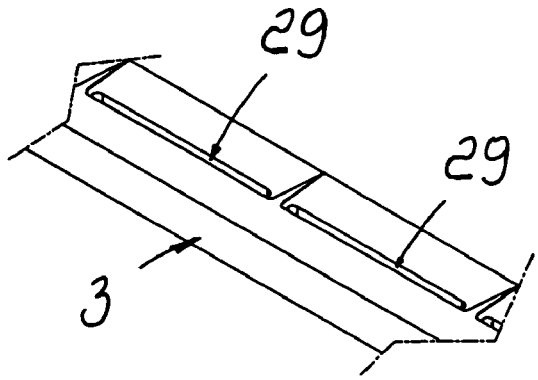
FIG. 11 is a view of a detail of the extrusion tool of the simplified configuration shown in FIG. 8.
Figure 12:
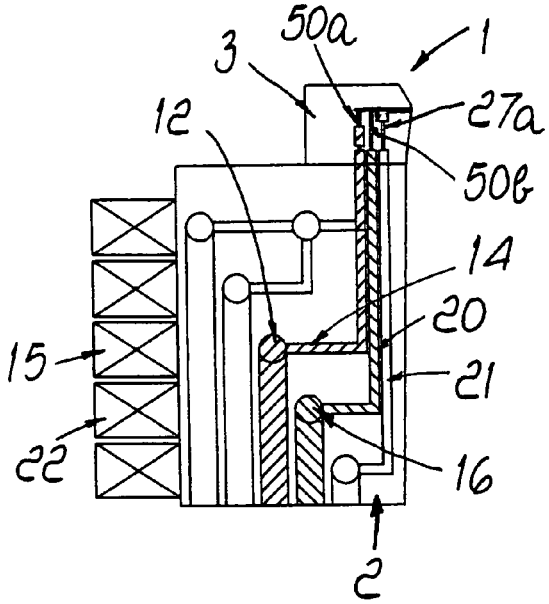
FIG. 12 is a view of another particular operating condition of a head according to the invention in a transverse cross-section which highlights also the first extrusion channels and the fourth feed channels, which are actually not visible.

In this simplified configuration, the extrusion tool 3 does not have the first extrusion channels but only one or more mixing chambers 28, each of which is connected in input to a first feed channel 11 and to a second feed channel 14 and in output to a second channel 29; as shown in FIG. 11, the various second extrusion channels 29 in this case are mutually laterally adjacent.

With reference to FIGS. 12 to 16, it is further possible to feed only the third duct 12 and the fourth duct 16 with two separate adhesives or as an alternative with a same adhesive having a different grammage.

Figure 15:
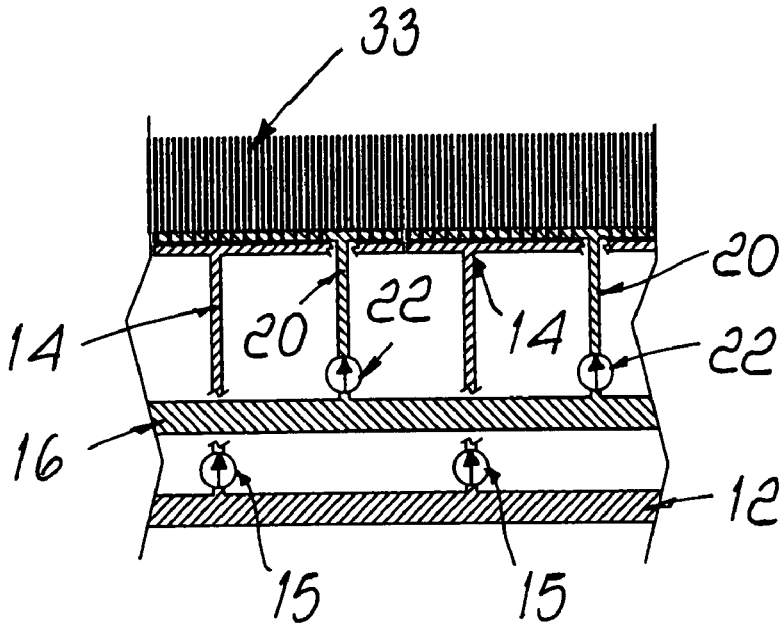
FIG. 15 is a schematic view of the path of the flows of the adhesives in the operating condition of FIG. 12.

As shown in FIG. 15, by appropriately adjusting the opening of the third valves 15 and fourth valves 22 it is possible to make the two adhesives converge within the microchannels 50*a* and 50*b* alone.

Figure 13:
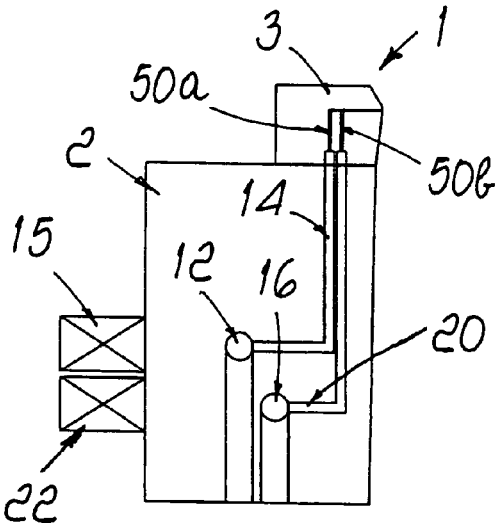
FIG. 13 is a transverse sectional view of a simplified configuration of a head according to the invention which corresponds to the particular operating configuration given in the description which refers to FIG. 12.
Figure 14:
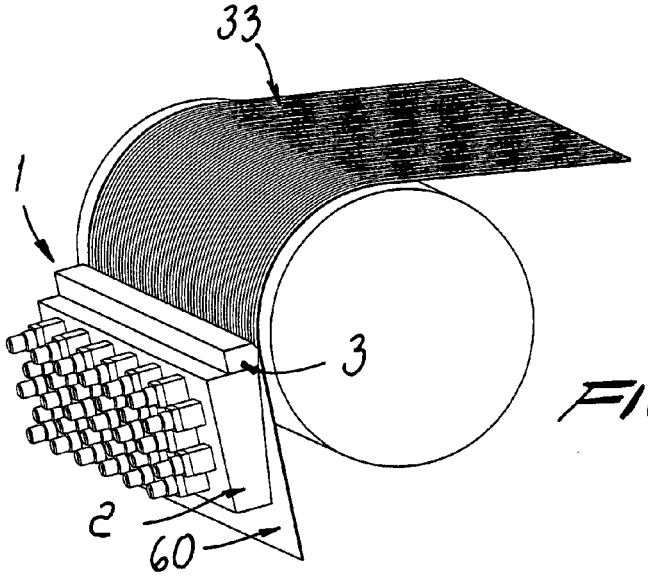
FIG. 14 is a perspective view of the head of FIG. 12.
Figure 16:
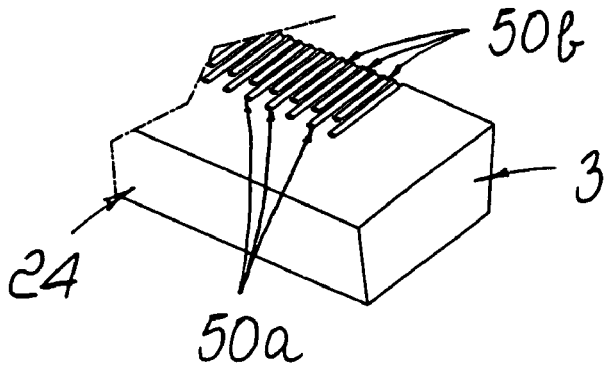
FIG. 16 is a view of a detail of the extrusion tool of the simplified configuration shown in FIG. 13.

If, as shown in FIGS. 13, 15 and 16, in the extrusion tool 3 there are only the microchannels 50*a* and 50*b*, it is possible to spread an alternation of microlayers, generally designated by the reference numeral 33, of the two adhesives.

With reference to FIGS. 13, 15 and 16, the distribution of the adhesive layers in output can also be achieved with a simplified configuration of the spreading head 1, in which the body 2 has only the third duct 12 and the fourth duct 16, from which a corresponding number of second and third feed channels 14 and 20 protrude respectively through one or more third valves 15 and fourth valves 22.

In this simplified configuration, the extrusion tool 3 is not provided with the mixing chambers 28 but only, as shown in FIGS. 13, 15 and 16, with the microchannels 50*a* and 50*b*, which are arranged in a comb-like configuration, are mutually alternated and are connected in input respectively to the second feed channels 14 and to the third feed channels 20.

Figure 17:
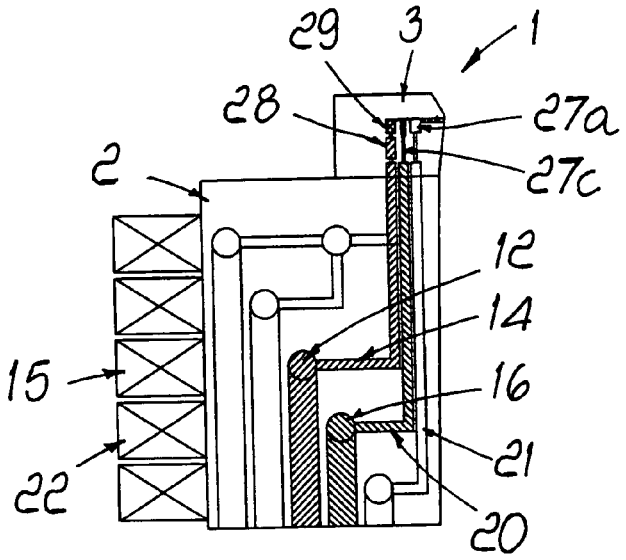
FIG. 17 is a transverse sectional view of another particular operating condition of a head according to the invention, illustrating also the first extrusion channels and the fourth feed channels, which are actually not visible.

With reference to FIGS. 17 to 21, it is further possible to feed only the third duct 12 and the fourth duct 16 with two separate adhesives or, as an alternative, with a same adhesive having a different grammage; as shown in FIG. 17, by means of the third valves 15 and the fourth valves 22 is possible to make one of the two adhesives converge into the mixing chambers 28 and from there into the second extrusion channels 29 and make the other adhesive converge into the additional first extrusion channels 27*c* which are interposed between the various second extrusion channels 29 which are arranged laterally side-by-side.

It is therefore possible to obtain in output from the extrusion tool 3 a series of layers of adhesive 32 which are laterally adjacent and are spaced by microlayers 33 of a different adhesive.

Figure 19:
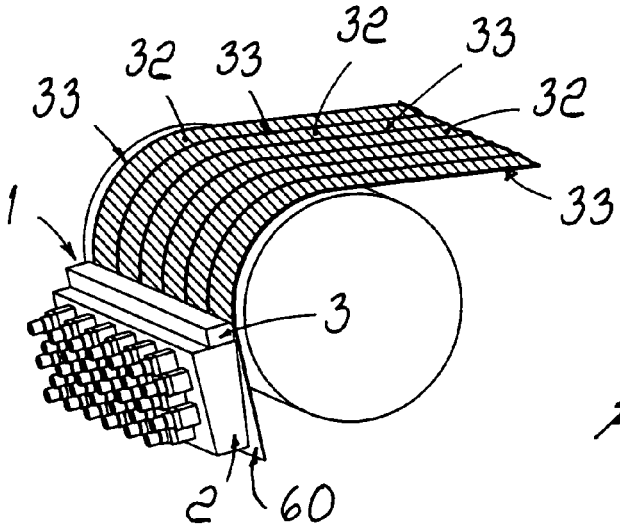
FIG. 19 is a perspective view of the head of FIG. 17.
Figure 20:
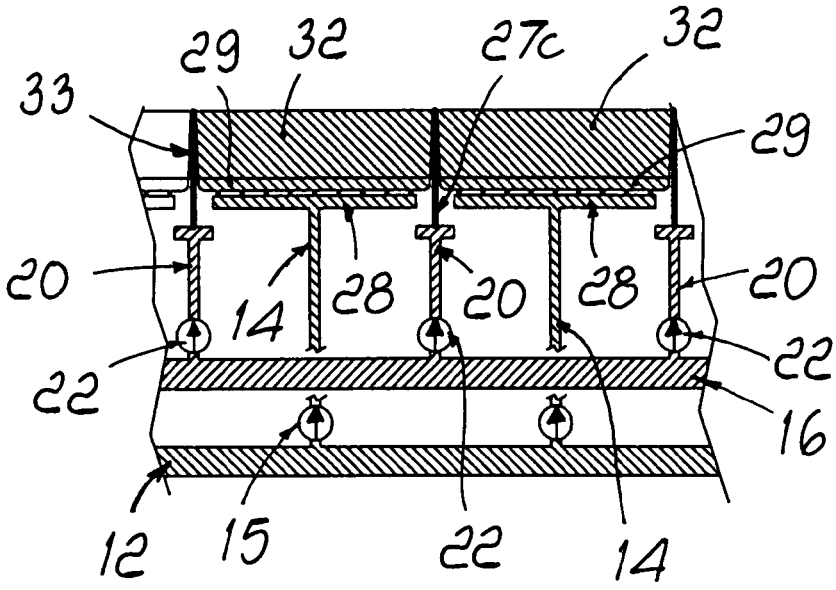
FIG. 20 is a schematic view of the path of the flows of the adhesives in the operating condition of FIG. 17.

For example, with reference to the embodiment shown in FIG. 19, six layers 32 of a first adhesive, each enclosed between two microlayers 32 of a second adhesive, have been obtained.

Figure 18:
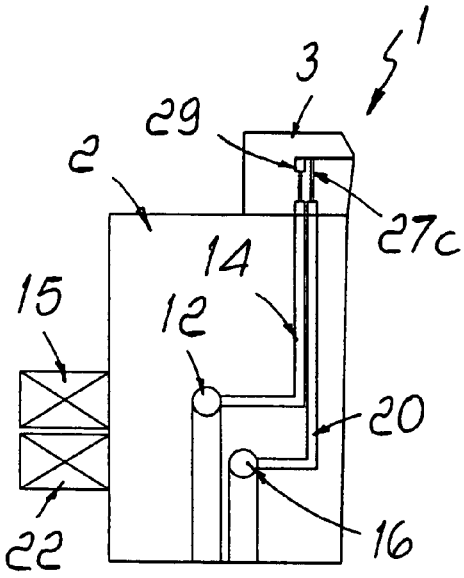
FIG. 18 is a transverse sectional view of a simplified configuration of a head according to the invention, which corresponds to the particular operating condition given in the description which refers to FIG. 17.
Figure 21:
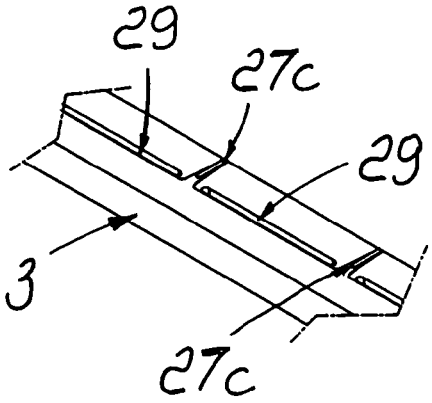
FIG. 21 is a view of a detail of the extrusion tool of the simplified configuration shown in FIG. 18.
Figure 22:
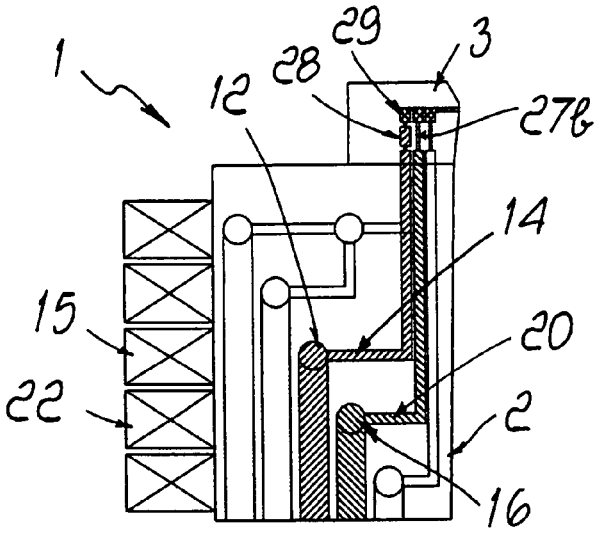
FIG. 22 is a transverse sectional view of another particular operating condition of a head according to the invention.

With reference to FIGS. 18 and 21, this distribution of the layers of adhesive in output can also be achieved with a simplified configuration of the spreading head 1, in which the body 2 has only the third duct 12 and the fourth duct 16, from which a corresponding number of second and third feed channels 14 and 20 exit respectively through one or more third valves 15 and fourth valves 22.

In this simplified configuration, the extrusion tool 3 does not have the first extrusion channels below the second extrusion channels 29 but has only the additional first extrusion channels 27*c*, which are smaller and are arranged between the latter.

With reference to FIGS. 22 to 26, it is further possible to feed only the third duct 12 and the fourth duct 16 with two separate adhesives or, as an alternative, with a same adhesive having a different grammage; the third duct 12 and the fourth duct 16 are connected respectively to the mixing chambers 28 and therefore to the second extrusion channels 29 and to the first extrusion channels 27*b* which are contiguous to these last.

By acting on the open condition of the third valves 15 and the fourth valves 22 it is possible to make one or the other of the adhesives flow respectively to the second extrusion channels 29 or the contiguous first extrusion channels 27*b*; in this manner, it is possible to obtain in output from the extrusion tool 3 a series of layers of adhesive 32 which are laterally mutually adjacent and have the chosen composition.

Figure 24:
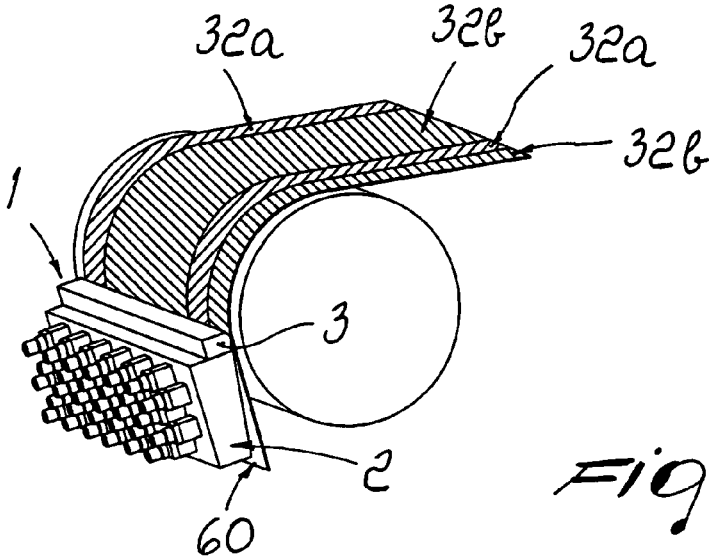
FIG. 24 is a perspective view of the head of FIG. 22.
Figure 25:
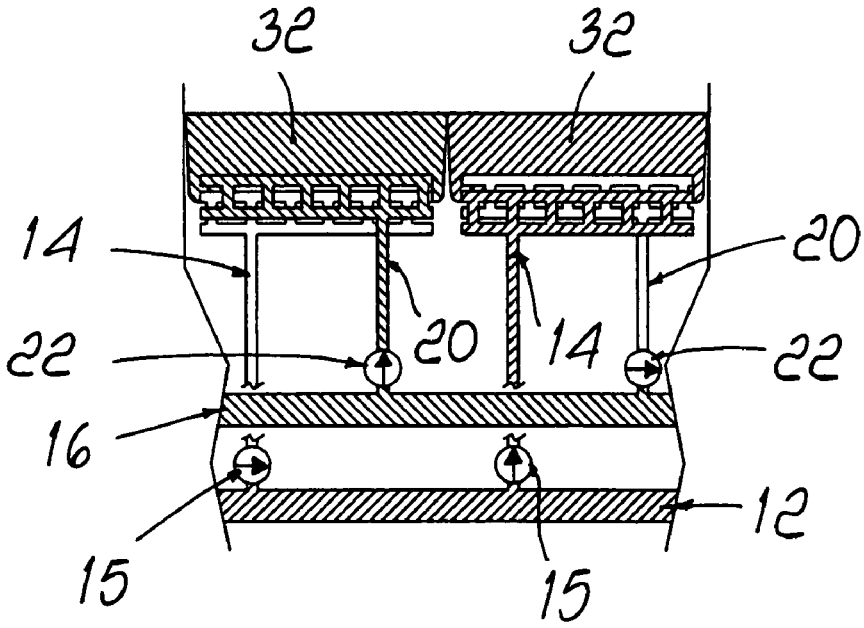
FIG. 25 is a schematic view of the path of the flows of the adhesives in the operating condition of FIG. 22.

In the embodiment shown in FIG. 24, for example, two first layers 32*a* of a first adhesive and two second layers 32*b* of a second adhesive, arranged alternately with respect to each other, have been obtained.

By opening both the third valve 15 and the fourth valve 22, which control the input respectively into a second extrusion channel 29 and into a first extrusion channel 27*b* arranged below the latter, it is possible to make both adhesives exit simultaneously from said first and second superimposed extrusion channels, so as to achieve the spreading of a double layer.

Figure 23:
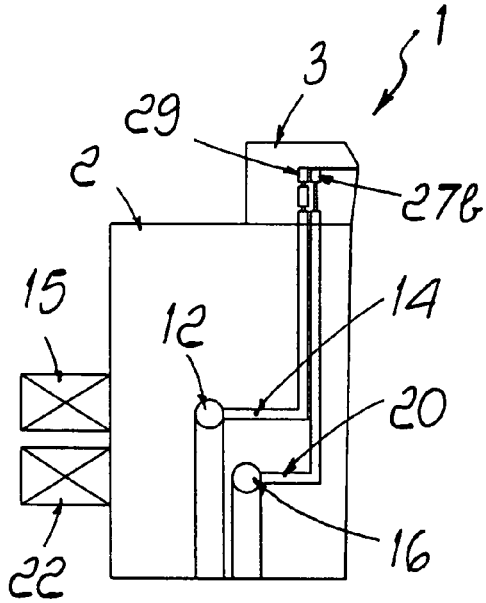
FIG. 23 is a transverse sectional view of a simplified configuration of a head according to the invention, which corresponds to the particular operating condition given in the description that refers to FIG. 22.
Figure 26:
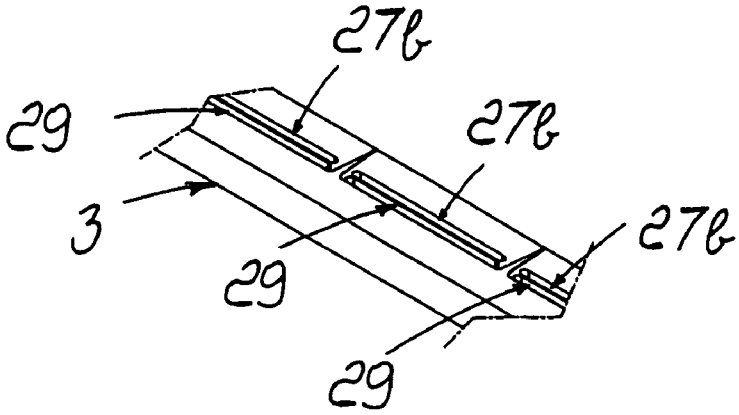
FIG. 26 is a view of a detail of the extrusion tool of the simplified configuration shown in FIG. 23.
Figure 27:
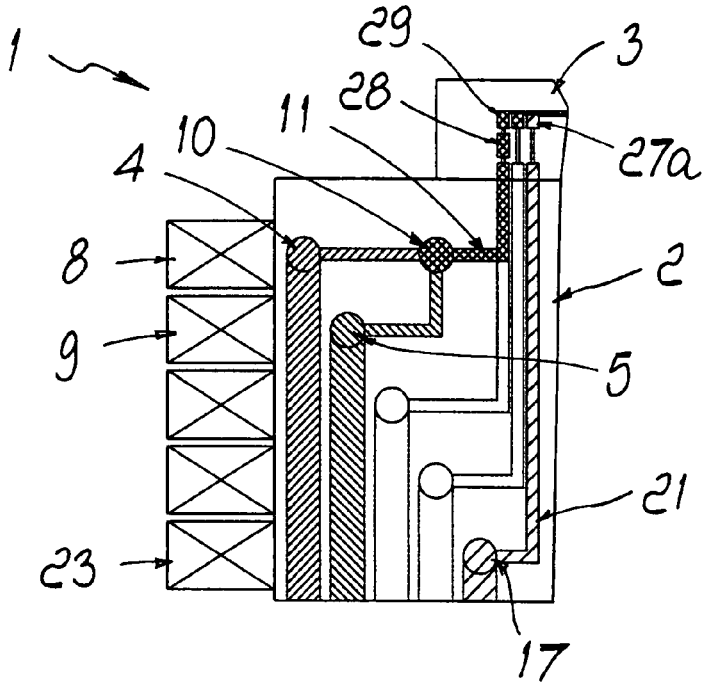
FIG. 27 is a transverse sectional view of a particular operating condition of a head according to the invention.

With reference to FIGS. 23 and 26, this distribution of the layers of adhesive in output can also be achieved with a simplified configuration of the spreading head 1, in which the body 2 has only the third duct 12 and the fourth duct 16, from which a corresponding number of second and third feed channels 14 and 20 exit respectively through one or more third valves 15 and fourth valves 22.

In this simplified configuration, the extrusion tool 3 has only a series of first extrusion channels 27*b* which are arranged below the second extrusion channels 29; one adhesive or the other can be fed respectively to a first channel 27*b* or to the overlying second extrusion channel 29 by opening or closing the respective fourth and third valves.

With reference to FIGS. 27 to 30, it is possible to feed the first duct 4 and the second duct 5 with two separate adhesives or with an adhesive and an appropriate catalyst and then the fifth duct 17 with an additional adhesive.

By opening the first and second valves 8 and 9, the adhesive or adhesives and the catalyst contained respectively in the first and second ducts enter the mixing channel 10, from which they exit, after being mixed, by means of the first extrusion channels 11, entering the mixing chambers 28 of the extrusion tool 3 and finally exiting from it by means of the second extrusion channels 29.

By opening the fifth valves 23, the adhesive contained in the fifth duct 17 enters the fourth feed channels 21 and then exits from the first (front) extrusion channels 27a arranged below the second extrusion channels 29.

Figure 30:
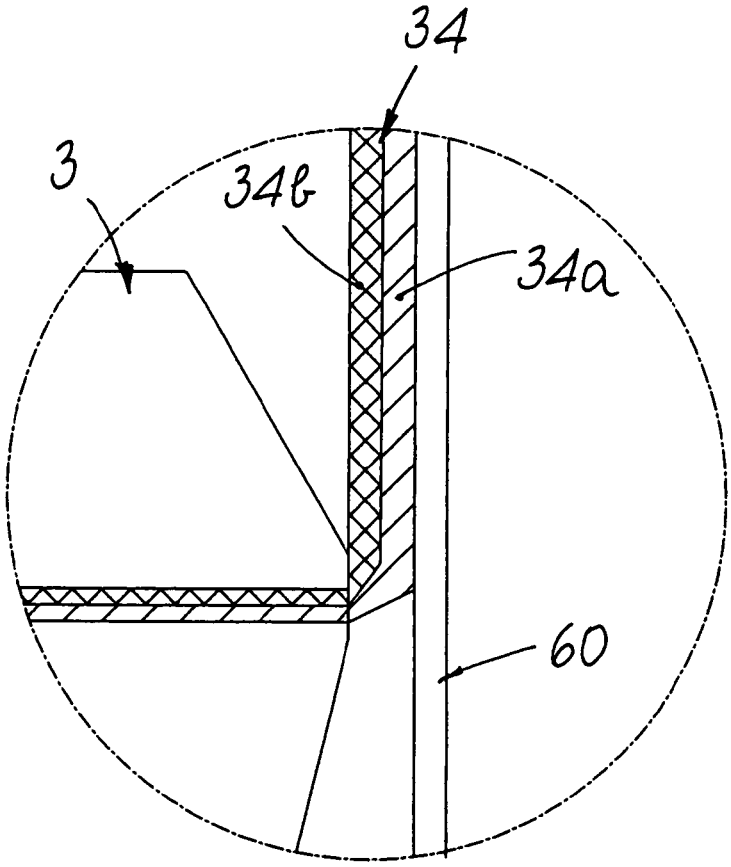
FIG. 30 is a schematic view of the provision of a double layer by using the operating condition of FIG. 29.
Figure 31:
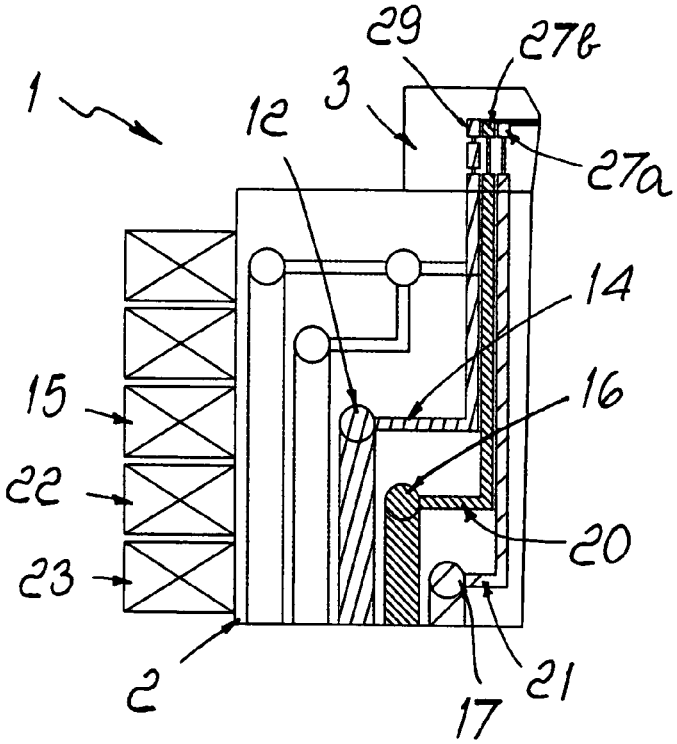
FIG. 31 is a transverse sectional view of another particular operating condition of a head according to the invention.

As shown in FIG. 30, the adhesive that exits from the second extrusion channels 29 and the adhesive that exits from the underlying first (front) extrusion channels 27*a* are extruded simultaneously; said adhesives remain one on top of the other due to their different relative densities, thus forming a double layer, designated in FIG. 30 by the reference numeral 34, which is composed of a lower layer 34*a* of the first adhesive (which arrives from the fourth feed channels 21)

and an upper layer 34*b* of the second adhesive (which arrives from the first feed channels 11).

By closing the first and second valves which enter a given mixing channel 10, or one of the fifth valves 23, it is also possible to achieve the extrusion of a single layer of adhesive or mixture of adhesives, respectively from one of the first (front) extrusion channels 27*a* or of the second extrusion channels 29; it is thus possible to obtain in output a chosen distribution of adhesives, not shown in the accompanying figures, which is constituted by a series of laterally adjacent layers, one or more of which is constituted by a single layer of one adhesive or the other, and one or more of which is constituted by a double layer which is similar to the one designated by the reference numeral 34 in FIG. 30.

Figure 28:
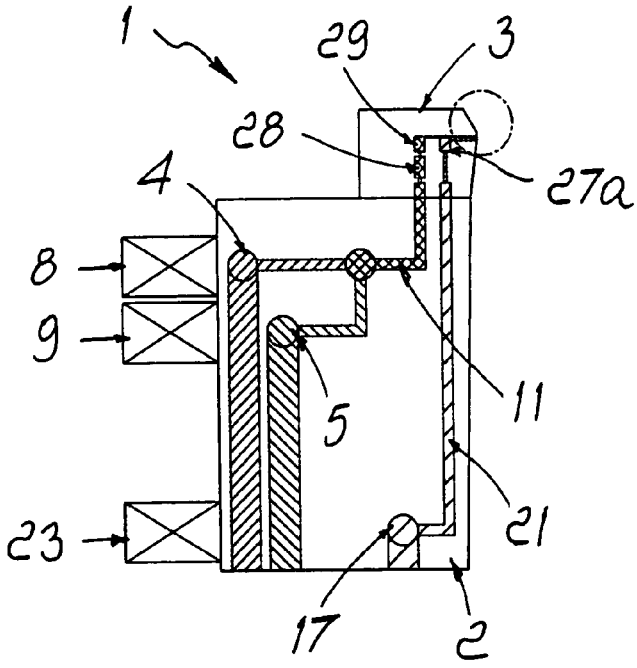
FIG. 28 is a transverse sectional view of a simplified configuration of a head according to the invention which corresponds to the particular operating condition given in the description with reference to FIG. 27.
Figure 29:
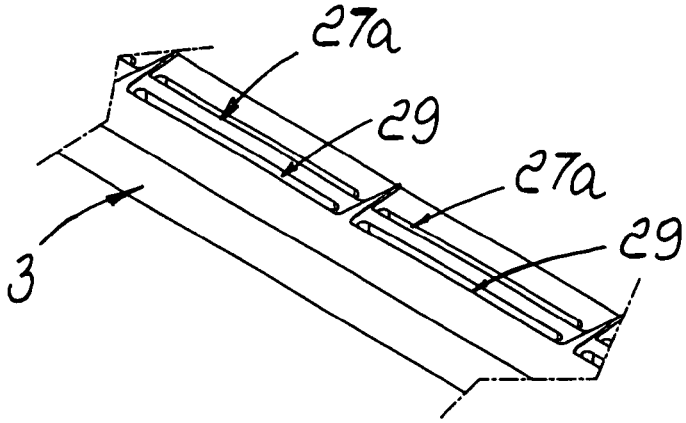
FIG. 29 is a view of a detail of the extrusion tool of the simplified configuration shown in FIG. 28.

With reference to FIGS. 28, 29 and 30, this distribution of the adhesive layers in output can also be achieved with a simplified configuration of the spreading head 1 in which the body 2 has only the first duct 4 and the second duct 5 which mutually converge in a suitable mixing channel 10 with the interposition of the first and second valves; the body 2 further has the fifth duct 17 which is connected, by means of the fifth valves 23, to the fourth feed channels 21.

In this simplified configuration, the extrusion tool 3 has only one series of first extrusion channels 27*a* which are arranged below the second extrusion channels 29.

With reference to FIGS. 31 to 34, it is further possible to feed the third duct 12, the fourth duct 16 and the fifth duct 17 with separate adhesives and/or with the same adhesive at different grammages.

By opening the third valves 15, the fourth valves 22 and the fifth valves 23, these adhesives enter respectively the second feed channels 14, the third feed channels 20 and the fourth feed channels 21 and from there flow into the extrusion tool 3.

Figure 34:
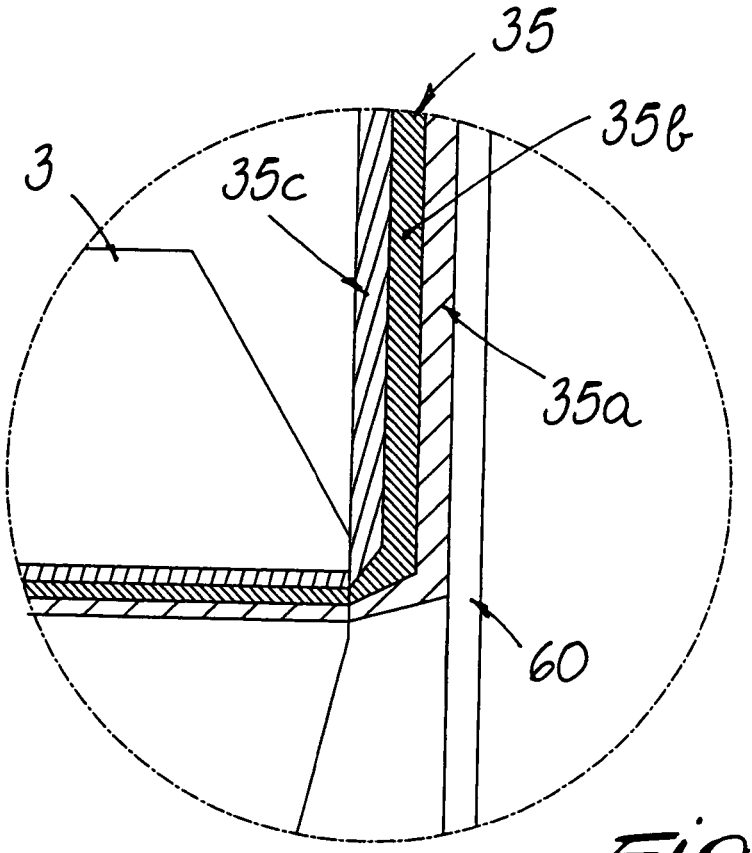
FIG. 34 is a schematic view of the provision of a triple layer by using the operating condition of FIG. 33.

The three adhesives thus exit simultaneously respectively from the first two extrusion channels 27*a* and 27*b* and from the second extrusion channel 29 so as to be mutually superimposed, forming a triple layer, designated in FIG. 34 by the reference numeral 35, which is constituted by a lower layer 35*a* of the first adhesive (which arrives from the fourth feed channels 21), by an intermediate layer 35*b* of the second adhesive (which arrives from the third feed channels 20), and by an upper layer 35*c* of the third adhesive (or optionally again of the first adhesive) (which arrives from the second feed channels 14).

By closing selectively the third, fourth and fifth valves, it is further possible to achieve the extrusion of a single layer of adhesive or also of a double layer; one can thus obtain in output a distribution of adhesives, not shown in the accompanying figures, which is constituted by a series of laterally adjacent layers, of which one or more is constituted by a single layer of a chosen adhesive and optionally one or more is constituted by a double layer and one or more is constituted by a triple layer.

Figure 32:
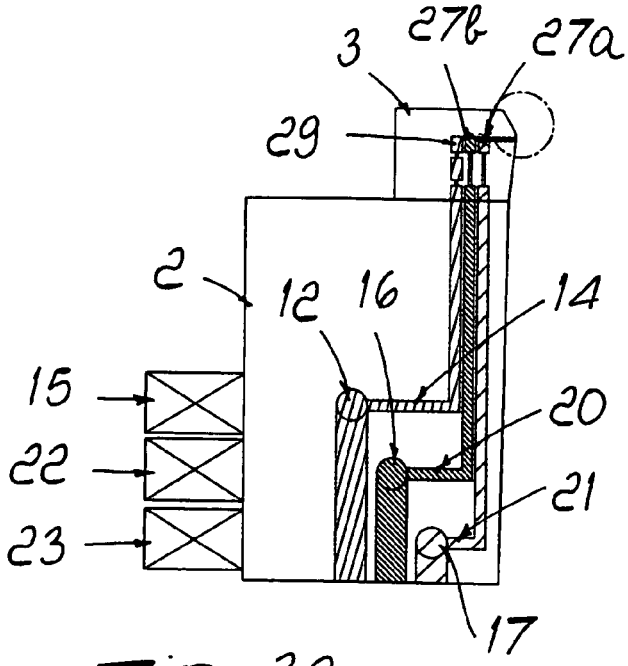
FIG. 32 is a transverse sectional view of a simplified configuration of a head according to the invention, which corresponds to the particular operating condition given in the description with reference to FIG. 31.
Figure 33:
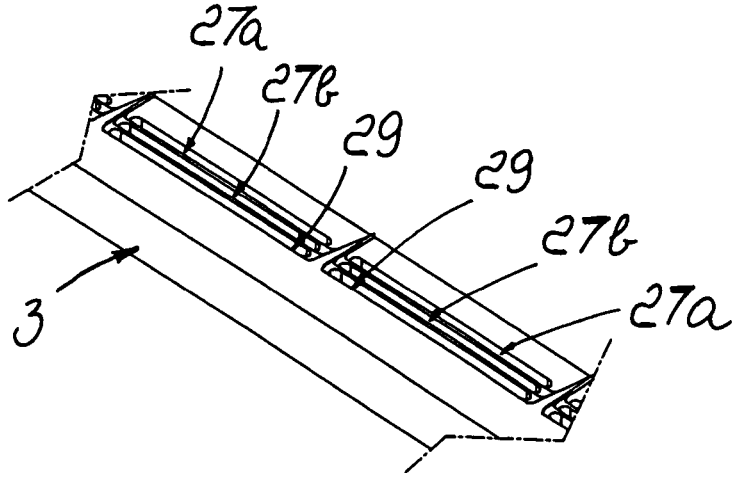
FIG. 33 is a view of a detail of the extrusion tool of the simplified configuration shown in FIG. 32.

With reference to FIGS. 32, 33 and 34, this distribution of the layers of adhesives in output can also be achieved with a simplified configuration of the spreading head 1, in which the body 2 has only the third, fourth and fifth ducts and the respective third, fourth and fifth valves, through which said ducts are connected respectively to the second, third and fourth feed channels.

In this simplified configuration, the extrusion tool 3 has multiple pairs of first extrusion channels 27*a* and 27*b* which are arranged below a second extrusion channel 29 and are laterally mutually adjacent.

It has thus been found that the invention has achieved the intended aim and objects, a spreading head having been devised which allows to apply to chosen areas of a substrate a chosen adhesive and/or different adhesives and/or a same adhesive with different grammages and/or a multiple layer of adhesives.

The spreading head according to the invention therefore allows to provide areas with differentiated grammage and also using differentiated adhesives, so as to be able to reduce (even by 70%, as has been found) the amount of (more expensive) structural adhesive that is required.

Further, the spreading head according to the invention allows to achieve the spreading on a substrate of a chosen number of layers of adhesive arranged side-by-side and having a chosen width.

Moreover, the spreading head according to the invention allows to mix various adhesives or an adhesive and a suitable catalyst both within the body and within the extrusion tool.

The spreading head according to the invention further allows to use sequentially adhesives which are chemically compatible with each other, since before applying the new adhesive it is sufficient to replace the extrusion tool; this reduces machine downtime with respect to the background art.

Moreover, the spreading head according to the invention allows in particular to achieve the mixing of the adhesives only in the extrusion tool, thus limiting the waste of already-mixed adhesive and the time required to clean the head, and further obviating product contaminations.

In the case of adhesives that must be mixed with catalysts, the spreading head according to the invention allows to provide said mixing directly in the extrusion tool, and this solves all the problems of circuit cleaning and allows to avoid wasting already-mixed product in case of machine downtime.

By means of the spreading head according to the invention it is further possible to achieve, even in a single pass, the spreading of a multilayer film of adhesives, so as to be able to use products with a good grip on different substrates.

Thanks to the possibility to achieve the spreading of adhesives in multiple layers, the need is further avoided to use high-value adhesives even if their use is required only by one of the two surfaces to which they are to be applied.

Moreover, in cases in which the adhesive, in addition to having a structural function, also has the task of "filling" porous surfaces (for example in the lamination of recycled products or of products on chipwood panel substrates), the spreading head according to the invention allows to reduce the waste of "high-value" product, by making a low-cost resin perform the nonstructural function and making a thin layer of high-value resin perform the structural effect.

Further, the spreading head according to the invention allows to provide, even with a single pass, a membrane which has breathability characteristics in certain regions and a vapor barrier effect in others.

Moreover, the spreading head according to the invention is suitable for use for spreading thermoplastic adhesives and cold adhesives.

Moreover, the spreading head according to the invention allows the alternating application of hot and cold adhesives, since transition from one type of adhesive to the other merely entails replacing the extrusion tool.

Moreover, the production costs of the spreading head according to the invention remain low, since it is made of components which are easy to manufacture and/or assemble.

The invention is of course susceptible of numerous modifications and variations, all of which are within the scope of the appended claims.

Figure 35:
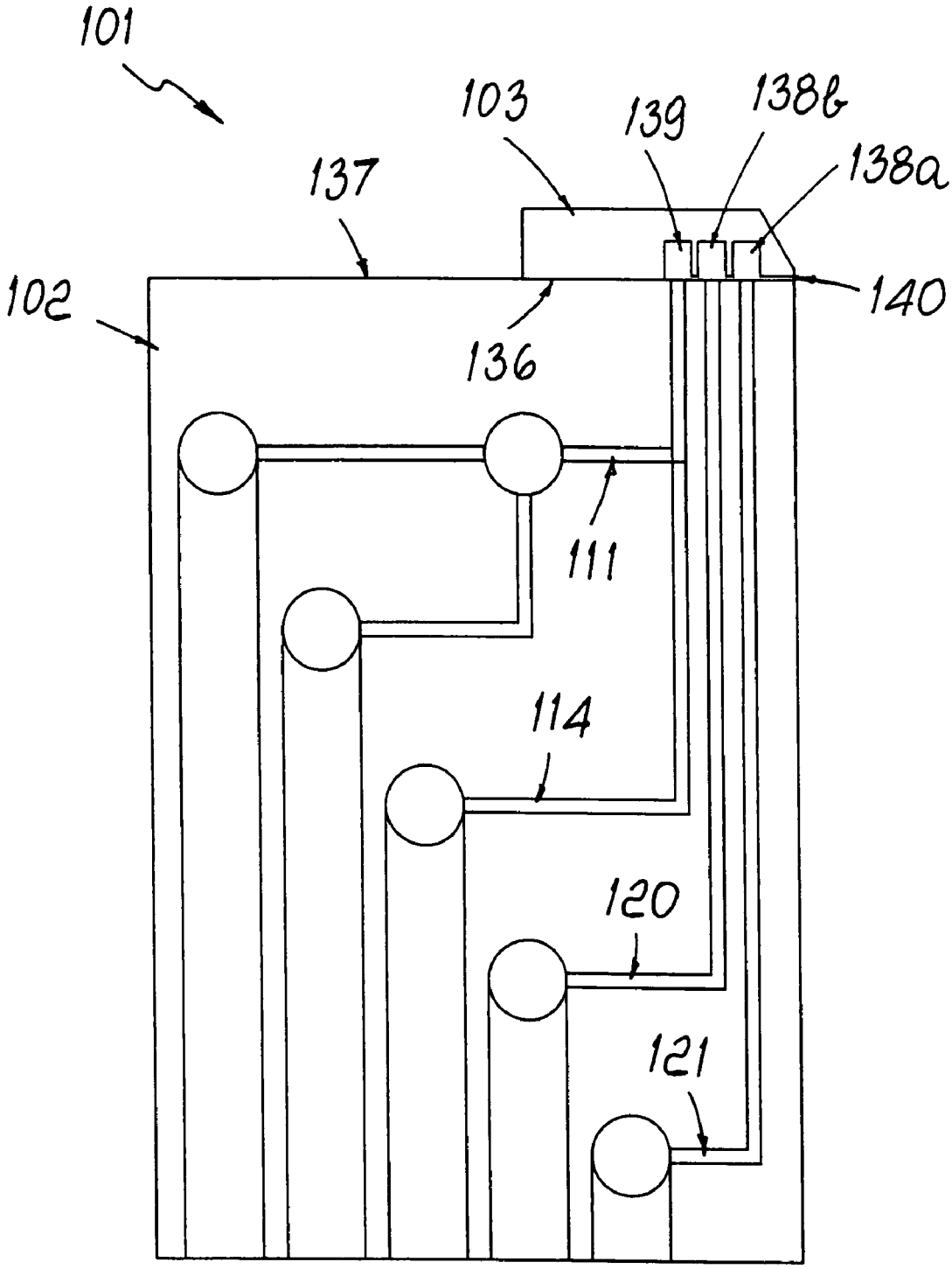
FIG. 35 is a schematic view of a different embodiment of the head according to the invention, highlighting the second feed channels, which are actually not visible because they are arranged on different planes.
Figure 36:
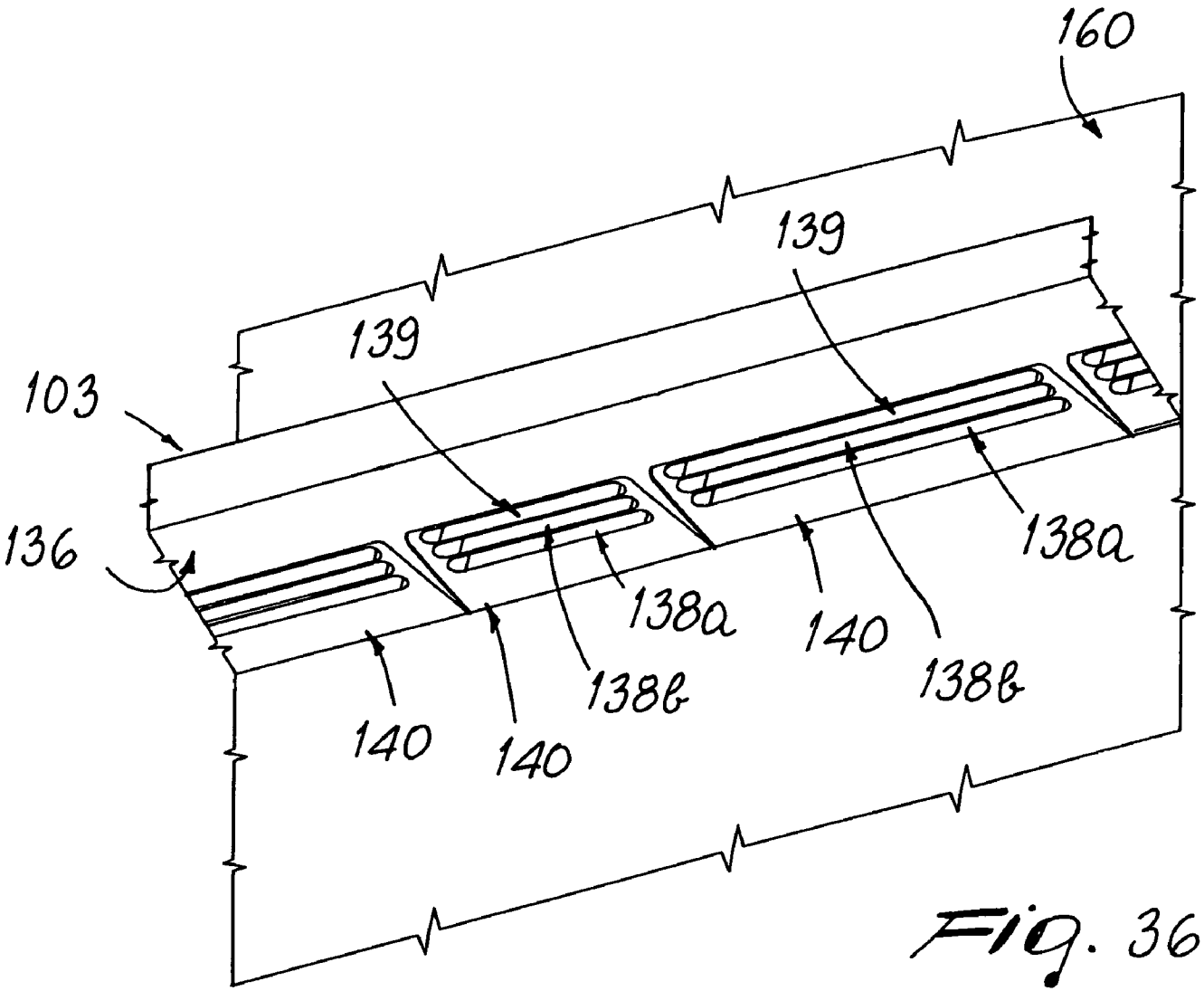
FIG. 36 is a perspective view of a detail of the extrusion tool of the spreading head of FIG. 35.

Thus, for example, FIGS. 35 and 36 illustrate a spreading head 101 in which the extrusion tool 103 is constituted by a single block which is preferably shaped, in a transverse cross-section, approximately like a right-angled trapezoid and is superimposed, with its lower surface 136, on the underlying upper surface 137 of the body 102 at the outlets of the first feed channel 111, of the second feed channel 114, of the third feed channel 120 and of the fourth feed channel 121.

In this embodiment, the first extrusion channels formed in the extrusion tool 103 are each constituted by a first cavity 138*a*, 138*b*, which is formed in the lower surface 136 of the extrusion tool 103 and faces the outlet of one of the first, second, third and fourth feed channels formed in the body 102.

In the embodiment shown in FIGS. 35 and 36, the first cavities 138*b* and 138*a* face respectively the third feed channels 120 and the fourth feed channels 121 formed within the body 102.

In the embodiment shown in FIG. 36, multiple pairs of first cavities 138*a* and 138*b* are shown which are arranged so as to be mutually superimposed in pairs (i.e., arranged parallel to each other and to the longitudinal axis of the extrusion tool 103) and are also laterally adjacent in pairs; hereinafter, the first cavity 138*a* which during use lies closest to the substrate 160 will also be referenced as front cavity and the adjacent first cavity 138*b* will be referenced also as rear cavity.

As shown in FIG. 36, the longitudinal extension of each pair of first cavities 138*a* and 138*b* is identical, while the longitudinal extension of two laterally adjacent pairs of first cavities 138*a* and 138*b* may be different.

In this embodiment, each mixing chamber and the respective one or more second extrusion channels are constituted by a single second cavity 139, which is formed in the lower surface 136 of the extrusion tool 103 and faces the outlet of one of the first, second, third and fourth feed channels formed within the body 102.

In the embodiment shown in FIGS. 35 and 36, the second cavities 139 face respectively the first feed channels 111 and/or the second feed channels 114 which are formed within the body 102.

Advantageously, each second cavity faces respectively at least one first feed channel 111 and at least one second feed channel 114, so as to allow the simultaneous introduction therein (and the consequent mixing therein) of two different adhesives or of an adhesive and a suitable catalyst.

Advantageously, the second cavities 139 are optionally superimposed and/or laterally adjacent to each other and/or to the first cavities 138*a*, 138*b*; in the example shown in FIGS. 35 and 36, the second cavities 139 are mutually laterally adjacent, each cavity being superimposed on a pair of first cavities 138*a* and 138*b*.

The shape, and therefore the size, of the second cavities 139 follows the shape and size of the first cavities 138*a* and 138*b* at each of the pairs thereof on which they are superimposed.

The various pairs of first cavities 138*a*, 138*b* which are mutually superimposed and the adjacent second cavities 139 may have mutually different extensions; thus, for example, as shown in FIG. 36, some pairs of first cavities 138*a*, 138*b* which are mutually superimposed and the adjacent second cavities 139 can have a shorter extension than the pairs of first cavities 138*a* and 138*b* which are mutually superimposed and of the second adjacent cavities 139, allowing to obtain in output laterally adjacent adhesive layers of different width.

Advantageously, one or more recesses 140 are formed on the lower surface 136 of the extrusion tool 103, preferably by removing material and so that each one affects a pair of first cavities 138*a*, 138*b* which are mutually superimposed and the adjacent second cavities 139, said recesses being suitable to allow the outflow of the adhesive or of the mixture of adhesives from the extrusion tool 103.

Advantageously, the one or more recesses 140 have a constant thickness and are formed along a plane which is approximately perpendicular to the lamination plane.

Operation is therefore as follows: with reference to FIGS. 35 and 36, for each pair of first mutually superimposed cavities 138*a*, 138*b* and adjacent second cavity 139 it is possible to cause the convergent flow, from the underlying first, second, third or fourth feed channels alternately into one of the first cavities 138*a* or 138*b* or into the second cavity 139, of an adhesive or a mixture of adhesives, or also, in the case of the second cavity 139, of an adhesive and an appropriately provided catalyst.

The adhesive or mixture of adhesives or adhesive and catalyst thus converge in the chosen cavity among the first or second cavities, filling it until it overflows from it; once it has exited from the respective first or second cavity, the flow of adhesive or mixture of adhesives, depending on the position of the first or second cavity from which it flows out, can be extruded directly by the tool 103, through the recesses 140, or can optionally enter and then exit from the contiguous first and/or second cavities to be finally extruded through the recesses 140.

Of course, the materials used, as well as the dimensions that constitute the individual components of the invention, may be more pertinent according to specific requirements.

The various means for performing certain different functions need not certainly coexist only in the illustrated embodiment but can be present per se in many embodiments, including ones that are not illustrated.

Of course, the selection of the feed to the extrusion tool of the chosen type of adhesive and/or mixtures of adhesives and/or catalysts can occur not only by activating or not activating the mentioned preset valves but also by virtue of equivalent means, such as for example the interposition of appropriately provided plates which are selectively perforated between the body and the extrusion tool.

The characteristics indicated as advantageous, convenient or the like may also be omitted or be replaced with equivalents.

The disclosures in Italian Patent Application No. TV2006A000124 from which this application claims priority are incorporated herein by reference.

What is claimed is:

1. A spreading head for spreading adhesives onto a substrate, comprising:

an extrusion tool in fluid communication with at least a first adhesive and a second adhesive for application onto said substrate;

a body for conveying said first adhesive and said second adhesive to said extrusion tool;

two or more ducts formed within said body for introducing in said ducts said first and second adhesives, said ducts being mutually separate ducts such that said first and second adhesives are introduced mutually separately in said ducts;

for each respective duct of said ducts, a plurality of feed channels formed within said body and exiting from each respectively duct and distributed and spaced along a longitudinal extension of each respective duct, and said plurality of feed channels connected in output to said extrusion tool by a plurality of valves which allow to selectively feed through said plurality of feed channels into said extrusion tool said first and second adhesives from said ducts; and a plurality of extrusion channels comprising at least two extrusion channels that are arranged mutually laterally adjacent in said extrusion tool with respect to a width of said extrusion tool, said two mutually laterally adjacent extrusion channels being connected with respective ones of said feed channels such that said first and second adhesives introduced mutually separately in said two mutually separate ducts also being capable of exiting mutually separately from said two mutually laterally adjacent extrusion channels so as to obtain at least two layers of adhesive which are arranged laterally mutually adjacent on said substrate and which include said first adhesive which is arranged laterally mutually adjacent to said second adhesive on said substrate.

2. The spreading head of claim 1, wherein said plurality of extrusion channels comprise first extrusion channels and second extrusion channels and said body has two separate ducts and said tool has one or more mixing chambers which are connected to one or more of said second extrusion channels, said second extrusion channels being mutually laterally adjacent.

3. The spreading head of claim 1, wherein said plurality of extrusion channels comprise first extrusion channels and second extrusion channels and said body has two separate ducts and wherein said first and second extrusion channels have, along a longitudinal axis with respect to said extrusion tool, reduced lengths that are mutually parallel and are perpendicular to said longitudinal axis.

4. The spreading head of claim 1, wherein said body has two separate ducts and said tool has one or more first extrusion channels which are mutually laterally adjacent and are spaced by one or more additional first extrusion channels which have a different shape and arrangement with respect to the remaining ones among said first extrusion channels.

5. The spreading head of claim 1, wherein said body has two separate ducts and said tool has one or more first extrusion channels which are mutually superimposed in pairs and are laterally adjacent in pairs with respect to each other.

6. The spreading head of claim 1, wherein said body has three ducts, two of which converge, and wherein said tool has at least two first extrusion channels which are mutually superimposed in pairs and are laterally adjacent in pairs with respect to each other.

7. The spreading head of claim 1, wherein said body has three distinct ducts comprising a first duct, a second duct, and a third duct, and said tool has at least two first extrusion channels which are mutually superimposed in pairs and are mutually laterally adjacent in pairs, and at least one second extrusion channel which is superimposed on each pair of said first extrusion channels.

8. The spreading head of claim 7, wherein said first duct and said second duct being approximately mutually parallel and affecting said body longitudinally, and having respectively one or more first and second accesses for said adhesives, said first and second ducts being mutually connected internally with respect to said body.

9. The spreading head of claim 8, wherein said first and second ducts are connected respectively to one or more first and one or more second output ducts which converge in pairs, with the interposition of first and second valves, in suitable mixing channels, from each of which there protrudes at least one first feed channel which is connected in output to said extrusion tool.

10. The spreading head of claim 9, wherein said one or more first and second output ducts are also formed along axes which are substantially perpendicular to said first and second duct, said one or more first and second output ducts being distributed, so that they are equidistant, respectively along said first and second ducts.

11. The spreading head of claim 10, wherein said third duct is approximately parallel to said first and second ducts, affects longitudinally said body, and has one or more third accesses for said adhesives, one or more second feed channels protruding from said third duct and being connected in output to said extrusion tool and being connected to said third duct by means of third valves.

12. The spreading head of claim 11, wherein the outputs of said second feed channels and of said first feed channels are mutually aligned approximately according to a same axis longitudinally with respect to said body, said second feed channels being formed along axes which are substantially perpendicular to the longitudinal axis of said third duct and being distributed, so that they are equidistant, along said third duct.

13. The spreading head of claim 11, wherein said body has a fourth duct, which is approximately parallel to said first, second and third ducts, affects longitudinally said body, and is provided with fourth accesses for said adhesives, one or more third feed channels protruding from said fourth duct and being connected in output to said extrusion tool and connected to said fourth duct by means of fourth valves.

14. The spreading head of claim 13, wherein the outputs of said third feed channels are aligned approximately along an axis which is arranged longitudinally with respect to said body and is substantially parallel and spaced with respect to the axis along which the outputs of said first and second feed channels are aligned, said third feed channels being formed along axes which are substantially perpendicular to the longitudinal axis of said fourth duct, and being distributed along said fourth duct.

15. The spreading head of claim 13, wherein said body has a fifth duct, which is approximately parallel to said first, second and third ducts and affects longitudinally said body, and is provided with fourth accesses for said adhesives, one or more fourth feed channels protruding from said fifth duct and being connected in output to said extrusion tool and connected to said fifth duct by means of fifth valves.

16. The spreading head of claim 15, wherein the outputs of said fourth feed channels are aligned approximately along an axis which is arranged longitudinally with respect to said body and is substantially parallel and spaced with respect to the axes on which the outputs of said first and second feed channels and of said third feed channels are aligned, said fourth feed channels being formed on axes which are substantially perpendicular to the longitudinal axes of said fifth duct and being distributed along said fifth duct.

17. The spreading head of claim 16, wherein said extrusion tool is constituted by at least one lower element which can be fixed to said contiguous body and is approximately shaped like a parallelepiped with a transverse cross-section shaped like a right-angled trapezoid arranged with its shorter parallel side in engagement with said body and with its longer parallel side directed away from it.

18. The spreading head of claim 17, wherein one or more first extrusion channels are formed within said at least one lower element and are mutually superimposed and laterally adjacent, each channel being connected in input to one of said one or more first and/or second and/or third and/or fourth feed channels which exit from said body.

19. The spreading head of claim 18, wherein said one or more first extrusion channels are connected respectively to said one or more third feed channels or to said one or more fourth feed channels formed within said body.

20. The spreading head of claim 19, wherein said extrusion tool has one or more pairs of first extrusion channels which are arranged in pairs and are mutually superimposed and also mutually laterally adjacent in pairs, the longitudinal extension of said first extrusion channels of each of said pairs being identical.

21. The spreading head of claim 20, wherein in each of said pairs of said first mutually superimposed extrusion channels, the outlet of the channel which, among said extrusion channels, is also referenced as rear channel and lies furthest from the perimetric edge of said longer parallel side of said at least one lower element which is directed, during use, toward the substrate onto which said adhesives are to be spread, is located, with respect to a lamination plane, at a higher level than the other adjacent first channel, also referenced as front channel.

22. The spreading head of claim 21, wherein the plane of arrangement of said first front extrusion channel which is adjacent to said first rear extrusion channel is arranged at a lower level than said first rear extrusion channel in order to allow the extrusion of two superimposed layers of adhesive.

23. The spreading head of claim 2, wherein said extrusion tool has one or more additional first extrusion channels which have different configurations and arrangements with respect to said first extrusion channels.

24. The spreading head of claim 23, wherein said additional first extrusion channels are arranged along an axis which is perpendicular to the axis of said first extrusion channels and are interposed between each of said pairs of said first extrusion channels.

25. The spreading head of claim 24, wherein said additional first extrusion channels start from said perimetric edge of said longer parallel side of said at least one lower element which is directed toward said substrate during use.

26. The spreading head of claim 17, wherein said plurality of extrusion channels comprise first extrusion channels and second extrusion channels and in said at least one lower element of said extrusion tool there are one or more mixing chambers, each of which is connected to one or more said second extrusion channels, which are superimposed and laterally adjacent to each other and to said first extrusion channels.

27. The spreading head of claim 26, wherein said second extrusion channels are mutually laterally adjacent, each of said channels being superimposed on one of said pairs of said first extrusion channels.

28. The spreading head of claim 27, wherein the shape and size of said second extrusion channels follows the shape and size of said first extrusion channels at each of said pairs of said channels on which they are superimposed.

29. The spreading head of claim 28, wherein the plane of arrangement of each of said second extrusion channels is arranged at a higher level than said adjacent first rear extrusion channel.

30. The spreading head of claim 26, wherein each of said mixing chambers is connected to at least one of said first and second feed channels formed inside said body.

31. The spreading head of claim 28, wherein said pairs of said first extrusion channels and of said second extrusion channels which are mutually superimposed have mutually different or identical extensions.

32. The spreading head of claim 25, wherein on said longer parallel side of said at least one lower element of said extrusion tool there is a slit which affects the outlet at least of said first front extrusion channels, said slit arranging on a lower plane the outlet of said first front extrusion channel with respect to the plane of arrangement of said first rear extrusion channel and of said second extrusion channel, said slit guiding the outflow of the layer or layers of said adhesives from said extrusion tool onto said substrate.

33. The spreading head of claim 32, wherein one or more of said first extrusion channels and/or of said additional first extrusion channels and/or of said second extrusion channels have reduced lengths along an axis which is longitudinal with respect to said lower element.

34. The spreading head of claim 33, wherein said extrusion channels with reduced length are arranged at right angles to said first and second extrusion channels and are mutually parallel.

35. The spreading head of claim 34, wherein the shape of said extrusion channels with reduced length with respect to said longer parallel side of said lower element of said extrusion tool is comb-shaped, with teeth which have two mutually different lengths and are arranged alternately.

36. The spreading head of claim 35, wherein said first and second extrusion channels with reduced length are interposed between two of said pairs of said first and second extrusion channels.

37. The spreading head of claim 26, wherein said extrusion tool comprises at least one upper element, which can be fixed to said longer parallel side of said at least one lower element and is suitable to abut against said adhesives which protrude from said first and second channels formed in said at least one lower element, so as to guide said adhesives to exit from said slits.

38. The spreading head of claim 37, wherein said body has only said first and third ducts, from which said one or more first and second feed channels protrude respectively through said one or more first valves and one or more third valves, said extrusion tool having only said one or more mixing chambers, each of which is connected in input to one of said one or more first feed channels and to one of said one or more second feed channels and in output to one of said second extrusion channels, said second extrusion channels being laterally mutually adjacent.

39. The spreading head of claim 38, wherein said body has said third and fourth ducts, from which said one or more second and third feed channels protrude respectively through said one or more third and fourth valves, said extrusion tool having extrusion channels with reduced length, which are arranged in a comb-like configuration and are mutually alternated and are connected in input respectively to said one or more second feed channels and to said one or more third feed channels.

40. The spreading head of claim 38, wherein said body has said third and fourth ducts from which said one or more second and third feed channels protrude respectively through said one or more third and fourth valves, said extrusion tool having said second extrusion channels and said additional first extrusion channels, which are smaller, arranged between said second extrusion channels.

41. The spreading head of claim 38, wherein said body has said third and fourth ducts from which said one or more second and third feed channels protrude respectively through said one or more third and fourth valves, said extrusion tool having a series of said first extrusion channels which are arranged below said second extrusion channels.

42. The spreading head of claim 38, wherein said body has said first duct and said second duct, which mutually converge in said mixing chamber with the interposition of said first and second valves, and said fifth duct, which is connected by means of said fifth valves to said one or more fourth feed channels, said extrusion tool having a series of said first extrusion channels arranged below said second extrusion channels.

43. The spreading head of claim 38, wherein said body has said third, fourth and fifth ducts, which are connected respectively, by means of said third, fourth and fifth valves, to said one or more second, third and fourth feed channels, said extrusion tool having a plurality of pairs of said first extrusion channels which are arranged below a said second extrusion channel and are mutually laterally adjacent.

44. The spreading head of claim 38, wherein said extrusion tool is constituted by a single block which is superimposed, with its lower surface, on the underlying upper surface of said body at the outlets of said first, second, third and fourth feed channels.

45. The spreading head of claim 44, wherein said first extrusion channels are each constituted by a first cavity which is formed in the lower surface of said extrusion tool and faces the outlet of one of said first, second, third and fourth feed channels.

46. The spreading head of claim 45, wherein said first cavities face respectively said third and fourth feed channels formed within said body.

47. The spreading head of claim 46, wherein it has one or more pairs of first cavities which are arranged in pairs so as to be mutually superimposed and also laterally adjacent in pairs with respect to each other.

48. The spreading head of claim 47, wherein each of said mixing chambers and the respective one or more second extrusion channels are constituted by a single second cavity, which is formed in said lower surface of said extrusion tool and faces the outlet of one of said first, second, third and fourth feed channels formed within said body.

49. The spreading head of claim 48, wherein said second cavities face respectively said first feed channels and/or said second feed channels.

50. The spreading head of claim 49, wherein each of said second cavities faces respectively at least one of said first and second feed channels, so as to allow the simultaneous introduction into said second cavity of two distinctive adhesives.

51. The spreading head of claim 50, wherein said second cavities are superimposed and/or laterally adjacent to each other and/or to said first cavities.

52. The spreading head of claim 51, wherein said second cavities are laterally mutually adjacent, each of said second cavities being superimposed on one of said pairs of said first cavities.

53. The spreading head of claim 52, wherein the shape and size of said second cavities follows the shape and size of said first cavities at each of said pairs of first cavities on which they are superimposed.

54. The spreading head of claim 53, wherein one or more recesses are formed on said lower surface of said extrusion tool so that each recess affects a said pair of said first cavities which are mutually superimposed and the adjacent said second cavities, said recesses being suitable to allow the outflow of said adhesives from said extrusion tool.

55. The spreading head of claim 54, wherein said one or more recesses have a constant thickness and are formed along a plane which is approximately perpendicular to a lamination plane.

* * * * *